US006107925A

United States Patent [19]

Wong

[11] Patent Number: 6,107,925

[45] **Date of Patent: *Aug. 22, 2000**

[54] METHOD FOR DYNAMICALLY ADJUSTING CRITERIA FOR DETECTING FIRE THROUGH SMOKE CONCENTRATION

[75] Inventor: Jacob Y. Wong, Goleta, Calif.

[73] Assignee: Edwards Systems Technology, Inc., Goleta, Calif.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/902,537

[22] Filed: Jul. 29, 1997

Related U.S. Application Data

[63] Continuation-in-part of application No. 08/593,750, Jan. 29, 1996, Pat. No. 5,691,704, and a continuation-in-part of application No. 08/593,253, Jan. 29, 1996, Pat. No. 5,767,776, and a continuation-in-part of application No. 08/744,040, Nov. 5, 1996, Pat. No. 5,798,700, which is a continuation of application No. 08/077,488, Jun. 14, 1993, Pat. No. 5,592,147.

[51] Int. Cl.[7] ..... G08B 17/10

[52] U.S. Cl. ..... 340/628; 340/630; 340/632

[58] Field of Search ..... 340/628, 630, 340/629, 286.05, 632, 522

[56] References Cited

U.S. PATENT DOCUMENTS

| | | | |
|---|---|---|---|
| 3,634,839 | 1/1972 | Flushing | 340/237 |
| 3,922,656 | 11/1975 | Horvath et al. | 340/237 |
| 4,093,867 | 6/1978 | Shah et al. | 340/515 |
| 4,099,178 | 7/1978 | Ranney | 340/515 |
| 4,103,997 | 8/1978 | Araki | 356/104 |
| 4,186,390 | 1/1980 | Enemark | 340/630 |
| 4,300,099 | 11/1981 | Maruyama | 328/6 |
| 4,490,715 | 12/1984 | Kusanagi et al. | 340/634 |
| 4,606,219 | 8/1986 | Bout | 73/23 |
| 4,638,304 | 1/1987 | Kimura et al. | 340/500 |
| 4,640,628 | 2/1987 | Seki et al. | 374/141 |
| 4,688,021 | 8/1987 | Buck et al. | 340/521 |
| 4,763,115 | 8/1988 | Cota | 340/628 |
| 4,833,450 | 5/1989 | Buccola et al. | 340/506 |
| 4,916,432 | 4/1990 | Tice | 340/518 |
| 5,026,992 | 6/1991 | Wong | 250/343 |
| 5,053,754 | 10/1991 | Wong | 340/632 |
| 5,079,422 | 1/1992 | Wong | 250/343 |
| 5,097,671 | 3/1992 | Jeong-Hun | 62/126 |
| 5,100,479 | 3/1992 | Wise | 136/225 |
| 5,103,096 | 4/1992 | Wong | 250/343 |
| 5,117,219 | 5/1992 | Tice | 340/518 |
| 5,159,315 | 10/1992 | Schultz et al. | 340/539 |
| 5,163,332 | 11/1992 | Wong | 73/863.23 |
| 5,189,394 | 2/1993 | Walter | 340/525 |
| 5,260,687 | 11/1993 | Yamauchi | 340/588 |
| 5,261,596 | 11/1993 | Tachibana | 236/49.3 |
| 5,276,434 | 1/1994 | Brooks et al. | 340/632 |
| 5,280,272 | 1/1994 | Nagashima | 340/630 |
| 5,340,986 | 8/1994 | Wong | 250/343 |
| 5,341,214 | 8/1994 | Wong | 356/437 |

(List continued on next page.)

OTHER PUBLICATIONS

ANSI/Ul217–1985 (Approved Mar. 22, 1985), Standard For Single and Multiple Station Smoke Detectors, Underwriter's Laboratories, Inc.

*Primary Examiner*—Daniel J. Wu
*Assistant Examiner*—Anh La

[57] ABSTRACT

A fire detector is equipped with a smoke detector and electrical circuitry for declaring a fire alarm if a smoke concentration based fire detection criteria is satisfied. A $CO_2$ detector is included in the fire detector for forming an a priori estimate of the probability of the existence of a fire. If the a priori probability rises above a predetermined level, the smoke concentration base fire detection criteria of the smoke detector are altered to allow the more rapid detection of a fire.

26 Claims, 12 Drawing Sheets

U.S. PATENT DOCUMENTS

| | | | |
|---|---|---|---|
| 5,369,397 | 11/1994 | Wong | 340/632 |
| 5,376,924 | 12/1994 | Kubo et al. | 340/632 |
| 5,394,934 | 3/1995 | Rein | 236/49.3 |
| 5,420,440 | 5/1995 | Ketler | 250/573 |
| 5,523,743 | 6/1996 | Rattman | 340/630 |
| 5,526,280 | 6/1996 | Consadori | 340/632 |
| 5,530,433 | 6/1996 | Morita | 340/630 |
| 5,592,147 | 1/1997 | Wong | 340/522 |
| 5,598,147 | 1/1997 | Mochizuki et al. | 340/630 |
| 5,673,027 | 9/1997 | Morita | 340/628 |
| 5,691,703 | 11/1997 | Roby | 340/630 |
| 5,691,704 | 11/1997 | Wong | 340/630 |
| 5,721,430 | 2/1998 | Wong | 250/339.13 |
| 5,767,776 | 6/1998 | Wong | 340/632 |

METHOD FOR DYNAMICALLY ADJUSTING CRITERIA FOR DETECTING FIRE THROUGH SMOKE CONCENTRATION

RELATED PATENT APPLICATIONS

This is a continuation-in-part of application Ser. No. 08/593,750, filed Jan. 29, 1996 now U.S. Pat. No. 5,691,704; application Ser. No. 08/593,253, filed Jan. 29, 1996, now U.S. Pat. No. 5,767,776; and application Ser. No. 08/744,040, filed Nov. 5, 1996, now U.S. Pat. No. 5,798,700, which is a continuation of application Ser. No. 08/077,488, filed Jun. 14, 1993, now U.S. Pat. No. 5,592,147.

TECHNICAL FIELD

The present invention concerns a method for dynamically adjusting fire detection criteria.

BACKGROUND OF THE INVENTION

Fire detectors have been widely installed in both commercial buildings and residential structures to protect their inhabitants and other contents. These fire detectors are generally of the following three types: flame detector, thermal detector, or smoke detector. These three classes of detectors correspond to the three primary properties of a fire: flame, heat, and smoke.

Flame Detectors: A flame detector responds to the optical energy radiated from a fire and typically responds to non-visible wavelengths. One class of these detectors operates in the ultraviolet (UV) region below 4,000Å, and a second class of these detectors operates in the infrared region above 7,000Å. To prevent false alarms from other sources of UV or infrared light, flame detectors are constructed to respond only to radiation in one of these two regions that varies in intensity at a frequency characteristic of typical flicker frequencies of flames (i.e., a frequency in the range of 5 to 30 Hertz).

Although they exhibit a low rate of false alarms, flame detectors are relatively complex and expensive. Thus, these detectors are generally used only for applications in which cost is not a significant factor. For example, this type of detector is commonly used in industrial environments such as aircraft hangers and nuclear reactor control rooms.

Heat (Thermal) Detectors: Heat from a fire is dissipated by both laminar convective and turbulent convective flow. The convective flow is produced by the rising hot air and combustion gases within the plume of the fire. The two basic types of thermal detectors are threshold temperature detectors, which detect when a threshold temperature has been exceeded, and rate of rise detectors, which detect when a threshold rate of temperature increase has been exceeded.

Threshold temperature detectors are reliable, stable and easy to maintain, but are relatively insensitive. This type of detector is rarely used, especially in buildings having high airflow ventilation and air conditioning systems. Rate of rise detectors are typically used only in environments in which fires are expected to be fast-burning, such as chemical fires. The threshold for these detectors is typically about 15 degrees Fahrenheit per minute. Unfortunately, there is a significant rate of false detections for both types of thermal detectors.

A third type of thermal detectors has been recently introduced that indicates the presence of a fire only if both the temperature and rate of rise of the temperature exceed their respective thresholds. Although this eliminates a high fraction of the false detections, it also makes these detectors highly susceptible to failing to detect the actual occurrence of a fire. This requires that the location of these detectors be carefully selected. As a result, this type of fire detector is seldom used in residences. This type of detector is typically used in the same type of environment as the rate of rise detector.

Smoke Detectors: Since 1975, the United States has experienced remarkable growth in the use of home smoke detectors, principally single-station, battery-operated, ionization-mode smoke detectors. This rapid growth, coupled with clear evidence from actual fires and fire statistics of the lifesaving effectiveness of detectors, has made the home smoke detector the fire safety success story of the past two decades.

In recent years, however, studies of the operational status of smoke detectors in homes has revealed the alarming statistic that as many as one-fourth to one-third of all smoke detectors are nonoperational at any given time. Over half of the nonoperational smoke detectors are missing batteries. The rest have dead batteries or are broken. Homeowners' frustration over nuisance alarms (also referred to as "false alarms") is the principal reason for the missing batteries. Nuisance alarms are detector activations caused not by uncontrolled fires but by controlled fires, such as cooking flames. These nuisance alarms are also caused by nonfire sources, such as moisture vapor from someone taking a shower, dust or debris stirred up during the cleaning of living quarters, or oil vapors from cooking. To understand why the false alarm rate for currently available fire detectors is undesirably high, one must understand the standards that have been set for the performance of fire detectors and fire detection systems.

The present standard for common household fire detectors in the United States is contained in UL 217 Standard for Single and Multiple Station Smoke Detectors (Third Edition), which has been approved by the American National Standard Institute and is hereinafter referred to as ANSI/UL 217. ANSI/UL 217 covers (1) electrically operated single and multiple station smoke detectors intended for open area protection in ordinary indoor locations of residential units in accordance with the Standard for Household Fire Warning Equipment, NFPA 74, (2) smoke detectors intended for use in recreational vehicles in accordance with the Standard for Recreational Vehicles, NFPA 501C, and (3) portable smoke detectors used as "travel" alarms. ANSI/UL 268 is a similar standard for larger fire alarm systems that are typically installed in office buildings and commercial structures.

Recognizing that different types of fires have different characteristics, ANSI/UL 217 contains tests for paper, wood, gasoline, and polystyrene fires. The procedure for performing tests characteristic of each of these fires is set forth in paragraph 42 of ANSI/UL 217. According to paragraph 42.1 of ANSI/UL 217, the maximum response time for an approved fire detector is four minutes for paper and wood fire tests, three minutes for a gasoline fire test, and two minutes for a polystyrene fire test. Because the highest maximum response time is four minutes, it is common to refer to a maximum response time of four minutes for a residential fire detector without reference to the paper or wood fire tests. Although ionization flame detectors sold for residential use could be set to have a maximum response time of fewer than four minutes, most residential detectors have a maximum response time of about four minutes to minimize the occurrence of false alarms while still meeting the mandated response time standard.

Ionization-mode smoke detectors are prone to nuisance alarms because they are more sensitive to invisible particulate matter than to visible particulate matter. Because the alarm threshold must be set low enough for an alarm to be declared when primarily visible particulate matter is present, and because by that point considerable invisible particulate matter has been generated, false alarms often occur. Ionization type smoke detectors are prone to false alarms because they are more sensitive to invisible particulate matter (from 0.01 to 2 micron in largest dimension) than to visible particulate matter (from 2 microns to 5 microns in largest dimension). The detection threshold must be set quite low so that ionization type detectors can quickly detect those fires that do not produce a great deal of invisible particulate matter. This causes ionization type smoke detectors to issue false alarms when they encounter small amounts of invisible particulate matter produced by nonfire sources.

The problem of frequent false alarms among ionization smoke detectors, which results in a significant portion of them at any given time being unreliable, has led to the increased use in recent years of another type of smoke detector, the photoelectric smoke detector. Photoelectric smoke detectors work best for visible particulate matter and are relatively insensitive to invisible particulate matter. They are therefore less prone to nuisance alarms. However, their drawback is that they do not respond well to smoldering fires in which the early particulate matter generated is mostly invisible. To overcome this drawback, the fire alarm threshold of photoelectric smoke detectors must be set very low to meet the ANSI/UL 217 or ANSI/UL 268 certification requirements. Setting the fire alarm threshold for photoelectric smoke detectors so low leads to frequent false alarms. Thus the problem of nuisance false alarms for smoke detectors seems unavoidable.

Over the years the problem has been recognized but has not been solved. Frequent false alarms are not just a harmless nuisance; they may lead people to disarm smoke detectors by removing the battery to prevent such annoyances. This can be dangerous, especially when such people forget to re-arm their smoke detectors by replacing the battery. Frequent false alarms in fire detection systems in large buildings pose a safety hazard by leading occupants and fire fighters and other safety personnel to believe that any alarm is likely to be false. Regardless of the degree to which safety is stressed, the typical human reaction is to respond with less urgency to an alarm if frequent false alarms have been encountered in the past.

Another aspect of present-day smoke detectors that is often discussed but seldom addressed is the slowness of these detectors in detecting fire. The current ANSI/UL 217 and ANSI/UL 268 fire detector certification codes were developed years ago according to the then available fire detection technology—the smoke detector. Over the past two decades, workers in the fire fighting and prevention industries have been critical of the speed of response of the smoke detector. Obviously, increasing smoke the sensitivity of detectors by lowering their light obscuration detection thresholds speeds up their response. However, it also increases the nuisance alarm rates. It is clear that a better fire detector is needed.

Photoelectric smoke detectors can be divided into projected beam detectors and reflected beam detectors. The projected beam detector generally contains a series of pipes connected to the photoelectric detector. Air is drawn into the piping system by an electric exhaust pump. The photoelectric detector is usually enclosed in a metal tube with the light source mounted at one end and the photoelectric cell at the other end. Typically for this type of detector to be effective it must be long enough to accommodate a light beam of at least one meter in length so that small amounts of smoke will produce measurable amounts of attenuation. Unfortunately, this makes these detectors inconvenient to install. When visible smoke is drawn into the tube, the intensity of the light beam received by the photoelectric cell is reduced by the smoke particles. This reduction in intensity is detected by an electrical circuit connected to the photoelectric cell, which, in turn, activates the alarm. The projected beam or smoke obscuration detector was one of the first types of smoke detectors to be developed. In addition to its use on ships, this detector is commonly used to protect high-value compartments of storage areas and to provide smoke detection for plenum areas and air ducts.

The reflected light beam smoke detector has a light beam of only 5–7 cm in length, making it suitable for housing in the round, white, approximately 15 cm diameter cases, which will be familiar to most people. A reflected beam visible light smoke detector contains a light source, a photoelectric cell mounted at a right angle to the light source, and a light catcher mounted opposite to the light source.

For the past two decades, ionization smoke detectors have dominated the fire detector market. One of the reasons for this is that the other two classes of fire detectors, the flame and thermal detectors, are appreciably more complex and costly than ionization detectors. Therefore, flame and thermal detectors are primarily used in specialized high-value and unique-protection areas. In recent years, because of their relatively high cost, the photoelectric smoke detectors have significantly fallen behind in sales to the ionization types. Ionization detectors are generally less expensive and easier to use and can usually operate for a full year with one 9-volt battery. Today, over 90 percent of residences that are equipped with fire detectors use ionization smoke detectors.

Despite their low cost, relatively maintenance-free operation, and wide acceptance by consumers, these smoke detectors are not without problems and are certainly far from ideal. A number of significant drawbacks for ionization prevent them from operating as successfully as other early warning fire detectors.

One drawback to smoke detectors is the relatively slow and unpredictable dispersal characteristics of smoke. Unlike ordinary gases, smoke is a complex, sooty molecular cluster that consists mostly of carbon. It is much heavier than air and thus diffuses much more slowly than the gases we encounter every day. Therefore, if the detector happens to be some distance from the location of the fire, significant time will elapse before enough smoke gets into the sampling chamber of the smoke detector to trigger the alarm. Another drawback is the considerable variation in the amount of smoke produced by a fire. This depends on the composition of the material that catches fire. For example, oxygenated fuels such as ethyl alcohol and acetone generate less smoke than the hydrocarbons from which they are derived. Thus, under free-burning conditions, oxygenated fuels such as wood and polymethylmethacrylate generate substantially less smoke than hydrocarbon polymers such as polyethylene and polystyrene. Indeed, a small number of pure fuels, such as carbon monoxide, formaldehyde, metaldehyde, formic acid, and methyl alcohol, burn with nonluminous flames and do not produce smoke at all.

In an attempt to address the deficiencies, efforts have been made to develop a new type of fire detector. In this regard, it has been known for a long time that as a process, fire can take many forms, all of which involve a chemical reaction between combustible species and oxygen from the air. In other words, fire initiation is an oxidation process because it invariably entails the consumption of oxygen at the beginning. The most effective way to detect fire initiation, therefore, is to detect end products of the oxidation process. With the exception of a few very specialized chemical fires (i.e., fires involving chemicals other than the commonly encountered hydrocarbons), there are three elemental entities (carbon, oxygen, and hydrogen) and three compounds (carbon dioxide ("$CO_2$"), carbon monoxide, and water vapor) that are invariably involved in the chemical reactions or combustion of a fire.

Of the three effluent gases generated at the onset of a fire, $CO_2$ is the best candidate for detection by a fire detector. This is so because water vapor tends to condense easily on every available surface, causing its concentration to fluctuate wildly depending upon the environment and making it difficult to measure. Carbon monoxide is invariably generated in a lesser quantity than $CO_2$, especially at the beginning of a fire. Although significant amounts of carbon monoxide are produced at fire temperatures of greater than 600° Celsius, these amounts still do not equal the amounts of $CO_2$ concurrently produced. In addition to being generated abundantly from the start of the fire, $CO_2$ is a very stable gas.

Although it has been theorized for many years that detection of $CO_2$ would provide an alternative way to detect fires, $CO_2$ detectors are not widely used as fire detectors because past $CO_2$ detectors suffer drawbacks related to cost, moving parts, or false alarms. However, recent advances in the field of Nondispersive Infrared (NDIR) techniques have opened up the possibility of a viable $CO_2$ detector.

In U.S. Pat. No. 5,053,754 by Jacob Y. Wong entitled "Simple Fire Detector," a fire detector using NDIR techniques is proposed. A beam of 4.26-micron light is directed through a sample of room air to measure the concentration of $CO_2$ because $CO_2$ has a strong absorption peak at this wavelength. Both the concentration and the rate of change of concentration of the $CO_2$ are measured, enabling an alarm to be generated whenever either of these measured values exceeds its respective threshold value. Preferably, an alarm is sounded only if both of these values exceed their respective threshold values. The device is considerably simplified by the use of a window to the sample chamber that is highly permeable to $CO_2$ but keeps out particles of dust, smoke, oil, and water.

In U.S. Pat. No. 5,079,422 by Jacob Y. Wong entitled "Fire Detection System Using Spatially Cooperative Multi-Sensor Input Technique," individual sensors of a set of N sensors are spaced throughout a large room or unpartitioned building. Comparison of data from different sensors provides information that is unavailable from only a single sensor. The data from each of these sensors and/or the rate of change of such data are used to determine whether a fire has occurred. The use of data from more than one sensor reduces the likelihood of a false alarm.

In U.S. Pat. No. 5,103,096 by Jacob Y. Wong entitled "Rapid Fire Detector," a blackbody source produces a light that is directed through a filter that transmits light in two narrow bands at the 4.26-micron absorption band of $CO_2$ and at 2.20 microns, at which none of the atmospheric gases has an absorption band. A blackbody source is alternated between two fixed temperatures to produce light directed through ambient gas and through a filter that allows only these two wavelengths of light to pass. To avoid false alarms, an alarm is generated only when both the magnitude of the ratio of the measured intensities of these two wavelengths of light and the rate of change of this ratio are exceeded.

In U.S. Pat. No. 5,369,397 by Jacob Y. Wong entitled "Adaptive Fire Detector," a fire detector that includes a $CO_2$ sensor and a microcomputer is described that can alter the threshold detection level for $CO_2$ before an alarm is sounded to compensate for variations in the background concentration of $CO_2$.

Because virtually all fires generate $CO_2$, $CO_2$ detectors should be able to be used as fire detectors. However, two practical limitations have to be dealt with in designing a $CO_2$ fire detector.

First, although fires generate copious amounts of $CO_2$, one other commonly encountered type of source—people—also must be taken into account. The concentration level and rate of alarm thresholds for $CO_2$ fire detectors cannot be set arbitrarily low, because $CO_2$ generated by people's respiration in an enclosed space might be interpreted as a real fire. In practice, the rate of $CO_2$ generation by a typical fire can exceed that of human presence by several orders of magnitude. Thus, it is possible to see a $CO_2$ rate of rise threshold which exceeds the $CO_2$ rate of rise likely to be caused by human presence and yet is low enough to quickly detect most fires. Some types of smoldering fires, however, generate such small amounts of $CO_2$ that they are indistinguishable from human presence on the basis of rate or rise of $CO_2$.

Second, until the cost of an NDIR $CO_2$ detector is economically attractive, the consumer will be unwilling to purchase this improved fire detector. The concomitant effort to simplify and reduce the cost of an NDIR $CO_2$ detector is therefore important and relevant in introducing the currently disclosed practical and improved fire detector.

In U.S. Pat. No. 5,026,992, the present inventor began a series of disclosures on the novel simplification of an NDIR gas detector with the ultimate goal of reducing the cost of this device so it can be used affordably to detect $CO_2$ gas in its application as a fire detector. In U.S. Pat. No. 5,026,992, a spectral ratioing technique for NDIR gas analysis using a differential temperature source was disclosed that leads to an extremely simple NDIR gas detector comprising only one infrared source and one infrared detector.

In U.S. Pat. No. 5,163,332, the present inventor disclosed the use of a diffusion type gas sample chamber in the construction of an NDIR gas detector that eliminated virtually all the delicate and expensive optical and mechanical components of a conventional NDIR gas detector. In U.S. Pat. No. 5,341,214, the present inventor expanded the novel idea of a diffusion type sample chamber of U.S. Pat. No. 5,163,332 to include the conventional spectral ratioing technique in NDIR gas analysis. In U.S. Pat. No. 5,340,986, the present inventor extended the disclosure of a diffusion type gas chamber in U.S. Pat. No. 5,163,332 to a "re-entrant" configuration, further simplifying the construct of an NDIR gas detector.

There have been suggestions to combine different types of fire detectors to achieve economy of production by avoiding duplication of portions of the circuitry, and to provide information about which fire byproduct has been detected. In addition, there has been a suggestion for detecting a pre-fire condition, such as the presence of a hydrocarbon gas, to set a low threshold for the detection of a fire product. Unfortunately neither one of these options addresses the problem of setting a fire product detection threshold that permits the rapid detection of a common fire without resulting in the issuance of an inconveniently and dangerously high level of false alarms. Providing a detector for each of two or more different fire products and separately examining each detector output typically provides a fuller range of sensitivity to various types of fires. For example, an ionization smoke detector in conjunction with a photoelectric smoke detector will detect both smoldering and flaming fires. An alternative option is to combine a detector for a fire product gas with a smoke detector. The great weakness of this approach, however, is that the fire product concentrations could be just below both thresholds, i.e., the fire product gas threshold and the smoke threshold. As a result, this approach still has the potentially fatal shortcoming of failing to detect many types of fires in the beginning stages.

SUMMARY OF THE INVENTION

It is an object of the invention to provide a method for dynamically adjusting the smoke concentration fire detection criteria of a fire detection system.

It is an advantage of the invention that the fire detection response time of the smoke concentration fire detection criteria is decreased by easing the smoke concentration fire detection criteria when it is determined that the a priori (i.e., presupposed by experience) probability of a fire being in existence is above a predetermined level.

It is another advantage of the invention that the false alarm rate is decreased by increasing the smoke concentration fire detection criteria when it is determined that the a priori probability of a fire being in existence is above a predetermined level.

The present invention is a method for application in a fire detector having a smoke detector for producing a smoke detector output signal and electrical circuitry for receiving the smoke detector output signal and for generating an alarm signal in response to the satisfaction of a smoke detector output signal fire detection criterion. More specifically, the method is for dynamically adjusting the smoke detector output signal fire detection criterion and first comprises providing a carbon dioxide ($CO_2$) detector for forming a sequence of measurements of $CO_2$ concentration. This detector is connected to the alarm generating electrical circuitry. The measurements of $CO_2$ concentration are sent from the $CO_2$ detector to the electrical circuitry by way of the communicative connection. An estimate of the a priori probability of the existence of a fire is formed from the $CO_2$ measurements, and the smoke detector output signal fire detection criterion is altered accordingly.

Additional objects and advantages of this invention will be apparent from the following detailed description of preferred embodiments thereof, which proceeds with reference to the accompanying drawings

DETAILED DESCRIPTION OF PREFERRED EMBODIMENTS

Figure 1:
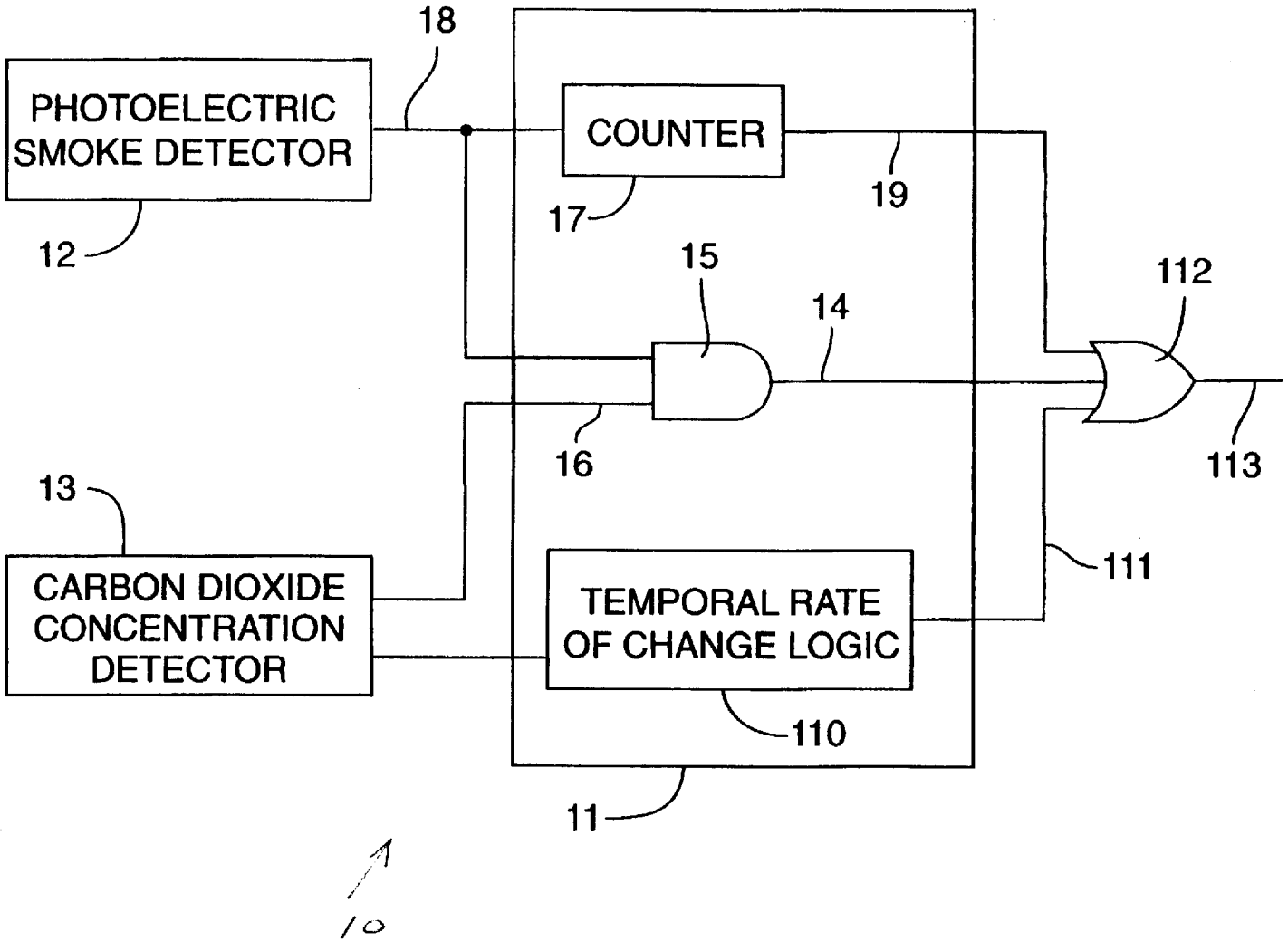
FIG. 1 is a block diagram of a fire detector having logic circuitry that is responsive to at least two different properties that are each characteristic of the occurrence of a fire to reduce the frequency of generating false alarms.

FIG. 1 is a block diagram of a fire detector 10 exhibiting a reduced rate of false alarms. It includes a logic circuit 11 that is responsive to at least two different properties that are characteristic of a fire to reduce the frequency of generating false alarms. Fire detector 10 includes a first detector module 12 that detects a first property $P_1$ that is characteristic of a fire and includes as a second detector module 13 that detects a second, different property $P_2$ that is also characteristic of a fire. Logic circuitry 11 includes a first output 14 on which a binary signal indicates whether a fire has been detected. Preferably, logic circuit 11 includes an AND gate 15 that produces a high output signal on first output 14 if and only if first detector module 12 and second detector module 13 each produce a high output that collectively indicates the presence of a fire. The output of second detector module 13 goes high when the property $P_2$ indicates that there is more than a predetermined a priori probability of the existence of a fire.

In a preferred embodiment of this fire detector, the first detector module 12 is a smoke detector that produces, on an output 18, a binary high signal if and only if the absorptivity (also referred to as "smoke concentration" and "light absorption") of ambient air exceeds a preselected threshold that is indicative of the occurrence of a fire. This smoke detector can be of any of several different types, including the ionization type of detector that is widely used at the present time and discussed above in the section entitled "Background of the Invention."

The second detector module 13 is a carbon dioxide concentration detector that produces, on an output 16, a binary high signal if and only if the detected concentration of carbon dioxide exceeds a preselected threshold level, which indicates that the probability of the existence of a fire is greater than a predetermined a priori probability. This carbon dioxide concentration detector can be any one of several different types, such as the types presented in U.S. Pat. Nos. 5,053,754; 5,079,422; and 5,103,096 discussed above in the section entitled "Background of the Invention."

This arrangement greatly reduces the rate of false alarms signaled on output 14. For example, the false alarms caused by steam from a shower will be suppressed because the output of the carbon dioxide concentration detector module 13 will be low, indicating a below threshold a priori probability of a fire. Similarly, the false alarms caused, for example, by a sufficient concentration of guests at a party to trigger the carbon dioxide-based fire detector module 13 when there is in fact no fire will be suppressed because the smoke detector 12 will not be signaling the presence of a fire. Although the a priori probability of fire in this case is high, the smoke concentration nevertheless fails to satisfy the lessened criterion.

Unfortunately, there are some types of fires in which this arrangement would fail to detect an actual fire. Because it is important to ensure that the suppression of false alarms does not produce a significant likelihood that fires which should be detected are not signaled, one or more override conditions that would not necessarily be signaled on output 14 are separately identified as sufficient to indicate the occurrence of a fire.

Two conditions have been identified as sufficient indications that a fire has occurred even when the signal on output 14 is low: the presence of a predetermined signal level from smoke detector module 12 for a period exceeding some threshold period, such as five minutes, and the detection of a carbon dioxide concentration rate of change exceeding 1,000 parts per million per minute. The first of these two cases occurs for a "cold" or nonflaming fire in which sufficient smoke is produced to trigger smoke detector module 12, but the rate of production of carbon dioxide is insufficient to produce a high signal on the first output of detector module 13. The second of these two cases occurs for a "hot" fire in which a large amount of carbon dioxide is produced, but very little smoke is produced.

It is important to include a pair of override paths that ensures both of these conditions will result in the production of an alarm. Therefore, logic circuit 11 includes a counter 17 that is connected to output 18 of first fire detector module 12. This counter is activated by a high signal from output 18 of smoke detector module 12 and is reset to zero each time output 18 of smoke detector module 12 becomes low. Counter 17 therefore functions as a clock that measures the duration of each interval in which the output from the smoke detector is high and resets to zero whenever the output of the smoke detector goes low. Counter 17 produces a high signal on a second output 19 of logic circuit 11 if and only if the value of this counter exceeds a preselected threshold level. In particular, this level is selected to correspond to five minutes, so that the signal on output 19 goes high if and only if smoke has been detected for more than five minutes.

Logic circuit 11 also includes temporal rate of change detector 110 that is responsive to the output signal from carbon dioxide concentration detector module 13 to measure the temporal rate of change of the output signal from detector module 13 and to produce, on a third output 111 of logic 11, a binary signal that is high if and only if the temporal rate of change of the output signal from the second fire detector module 13 exceeds a preselected threshold, such as 1,000 parts per million per minute. Skilled persons will readily recognize that detector module 13 may have an output that constitutes a sequence of $CO_2$ measurements in addition to a simple binary output.

An OR gate 112 is responsive to the signals on first output 14, second output 19, and third output 111 to produce on an output 113 a binary signal that indicates whether a fire has been detected. The most typical event that will produce an indication that a fire has been detected (i.e., a high signal on output 113) is the detection of a fire by the combination of the smoke detector module 12 and the carbon dioxide concentration detector module 13.

Because the operation of carbon dioxide concentration detector module 13 is much faster than that of smoke detector module 12, the detection speed of fire detector 10 is substantially as fast as that of the carbon dioxide concentration module 13. Thus, fire detector 12 exhibits more functionality than conventional smoke detectors (i.e., it also detects "hot" fires) while at the same time substantially eliminating false alarms without significantly delaying the detection of the majority of fires that generate sufficient smoke and carbon dioxide to trigger both fire detector modules 12 and 13.

This configuration constitutes a system in which the smoke detector output based fire detection criteria is dynamically adjusted by an estimate of the a priori probability of the existence of a fire. Before adjustment, the smoke concentration must exceed a predetermined smoke threshold continuously for greater than five minutes. When the concentration of $CO_2$ exceeds the $CO_2$ threshold, indicating that there is an estimated a priori probability of the existence of a fire in excess of a predetermined level, the smoke detector output based fire detection criterion is adjusted so that it is satisfied by the instantaneous breaching of the smoke threshold by the smoke detector output. Skilled persons will readily recognize that the estimate of the a priori probability of the existence of a fire need not be made explicitly by a percentage value stored in a register. Rather, if the measured concentration of $CO_2$ exceeds a particular value and if this value has been determined to be indicative of a particular probability of the existence of a fire, then an estimate of the a priori probability of the existence of a fire has been formed, requiring only interpretation to be formally posited.

The effective estimate of the a priori probability of the existence of a fire could also be formed through the testing of a statistic formed from the $CO_2$ measurements. For example, the output of temporal rate of change logic 110 could be used as an input to AND gate 15 to modify the smoke detector based fire detection criteria. Additionally, property $P_2$ detected by detector module 13 could constitute the occurrence of a predetermined pattern of $CO_2$ concentration over time that would satisfy a statistical test performed on a sequence of measurements of $CO_2$. The concentration of $CO_2$ changing at greater than a predetermined rate would be among the simplest of potential properties $P_2$. Many other properties are conceivable. For example, the following property is useful:

$$Q=X_N-aX_{N-1}<Threshold$$

where:

$X_N$=most recent $CO_2$ concentration measurement $X_{N-1}$=previous $CO_2$ concentration measurement a=a constant less than 1.0

The quantity Q is responsive to both rate of change and static value of $CO_2$ concentration.

Alternative preferred embodiments include a hybrid fire detector having a $CO_2$ concentration detector module and/or $CO_2$ concentration rate of change detector module in conjunction with some fire property other than smoke or $CO_2$ concentration. For example, these other embodiments contain a $CO_2$ concentration or $CO_2$ concentration rate of change detector module in conjunction with a flame detector and/or a heat detector module. In each of these cases, a bypass generates a fire alarm if either the $CO_2$ detector module or its companion fire detector module detects a condition that is sufficient by itself to clearly indicate the occurrence of a fire.

Figure 2:
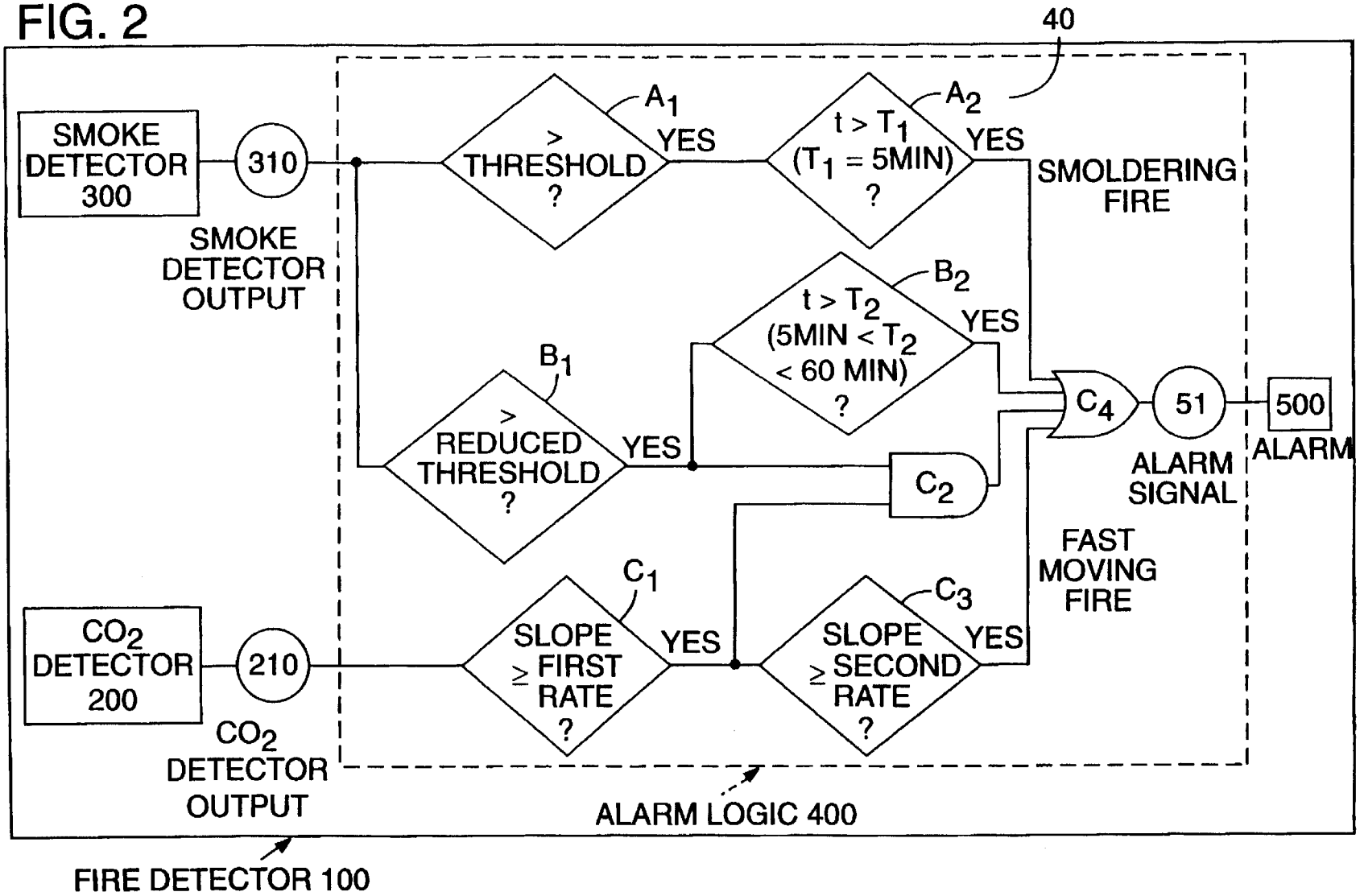
FIG. 2 is a logic diagram of a signal processor used in a preferred embodiment of the present invention.

FIG. 2 is a logic diagram of an embodiment of a practical and improved fire detection system 100. As illustrated in FIG. 2, fire detection system 100 generates an alarm signal 51 when any of four conditions are met. First, an alarm signal 51 will be generated if an output 310 of smoke detector 300 exceeds a threshold level $A_1$ of 3 percent light obscuration per 0.3048 meter (1 foot) for greater than a first preselected time $A_2$ of five minutes. Smoke concentration is typically measured in units of "percent light obscuration per 0.3048 meter (1 foot)." This terminology is derived from the use of projected beam or extinguishment photoelectric smoke detectors in which a beam of light is projected through air and the attenuation of the light beam by particles is measured. Even when referring to the measurements of a device that uses another mechanism for measuring smoke concentration, such as light reflection or ion flow sampling, the smoke concentration measurement is frequently specified in terms of percent light obscuration per 0.3048 meter (1 foot) because these units are familiar to skilled persons.

Second, an alarm signal 51 will be generated if output 310 from smoke detector 300 exceeds a reduced threshold level $B_1$ set at between 1 percent and 3 percent light obscuration per 0.3048 meter (1 foot) for greater than a second preselected time $B_2$ that is set to a value between 5 and 60 minutes. Third, an alarm signal 51 will be generated if the rate of increase in the measured concentration of $CO_2$ exceeds a first predetermined rate $C_1$ set at between 60 and 250 parts per million per minute for predetermined time period set to a value of fewer than 30 seconds and light obscuration exceeds the reduced threshold $B_1$. The output of an AND gate $C_2$ indicates the satisfaction of this condition. Fourth, an alarm signal 51 will be generated if the rate of increase in the measured concentration of $CO_2$ exceeds a second predetermined rate $C_3$ set to a value between 700 and 1,000 parts per million per minute for predetermined time period set to a value of fewer than 30 seconds. These four conditions are combined by an OR gate $C_4$, the output of which produces an alarm signal 51 that in turn activates an alarm 500.

Figure 3:
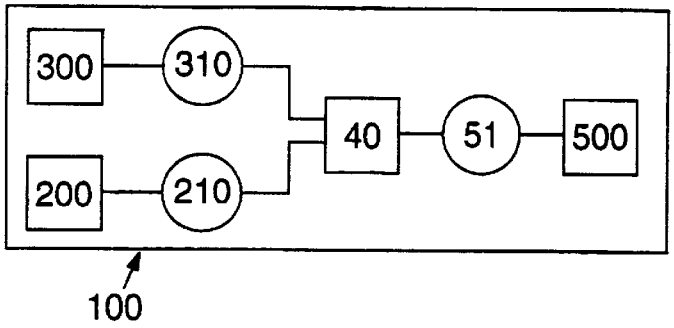
FIG. 3 is a block diagram of a preferred embodiment of the present invention.

In the preferred embodiment of the present invention shown in FIG. 3, fire detector 100 combines a smoke detector 300 with a $CO_2$ detector 200, and the detection outputs of the smoke detector and the $CO_2$ detector are fed to a signal processor 40 to determine whether an alarm signal 51 should be generated and sent to alarm 500. The $CO_2$ detector 200 generates an output signal 210 related to the $CO_2$ rate of increase in accordance with known principles of NDIR gas sensor technology. Moreover, skilled persons will recognize that whether $CO_2$ detector 200 or signal processor 40 extracts the $CO_2$ concentration rate of rise information makes no difference to the actual functioning of fire detector 100 and is transparent to the end user.

Smoke detector 300 generates an output signal 310 representative of light obscuration in accordance with known principles of smoke detector technology. The signal processor 40 uses alarm logic to determine whether alarm signal 51 should be generated. Although it is preferred that a single signal processor 40 be used, multiple signal processors can be used. Alternatively, portions of the alarm logic used to determine whether an alarm signal 51 should be generated can be implemented as part of smoke detector 300 or $CO_2$ detector 200.

In another aspect of the present invention, it is possible to build a fire detector with a very fast maximum response time in which a $CO_2$ detector is used to detect fires and a smoke detector is used to prevent false alarms. In this embodiment, shown in FIG. 4, alarm logic 40 does not use output 310 from the smoke detector 300 to detect smoldering fires. Instead, it is used solely as a test of the accuracy of the fire indication attributable to the $CO_2$ detector.

Figure 4:
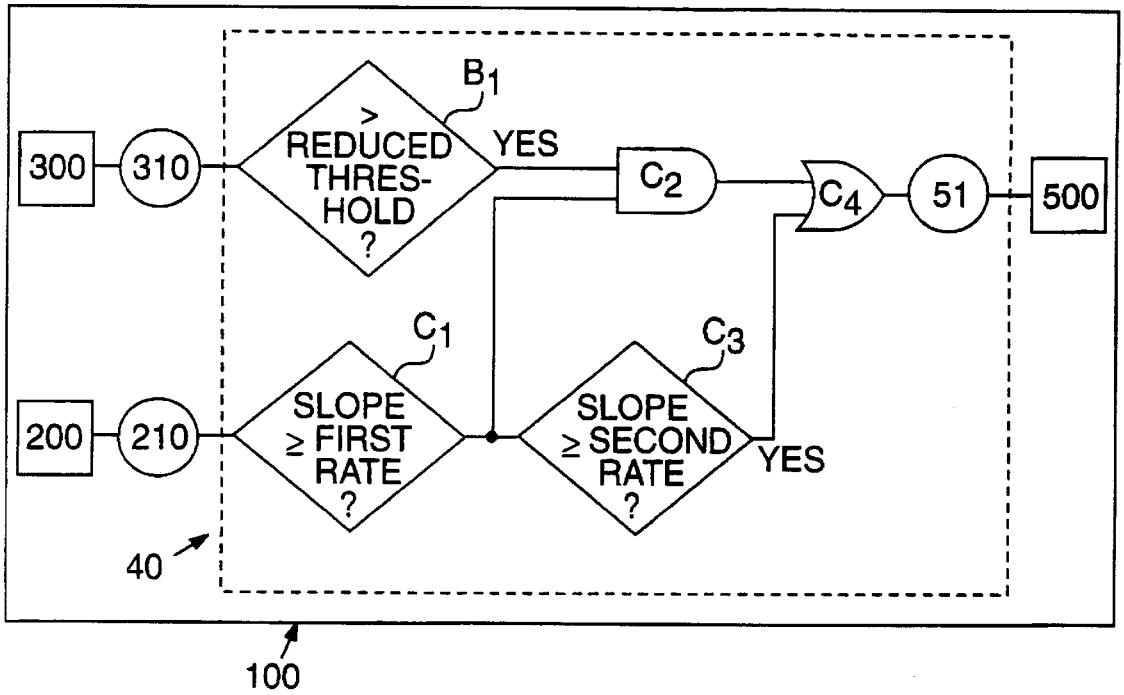
FIG. 4 is a flow diagram showing the logic of a signal processor in accordance with an alternative embodiment of the present invention.

As illustrated in FIG. 4, fire detector 100 generates an alarm signal 51 when either of two conditions is met. First, an alarm signal 51 will be generated if the rate of increase in the concentration of $CO_2$ exceeds a first predetermined rate $C_1$ and light obscuration exceeds a reduced threshold $B_1$. Second, an alarm signal 51 will be generated if the rate of increase in the concentration of $CO_2$ exceeds a second predetermined rate $C_3$.

As for the actual construction of a fire detector in accordance with the principles of the present invention, the components of the fire detector can be contained in a single package; alternatively, and less preferably, the individual components need not be contained in a single package. The fire detector can contain an alarm that is audible or visual or both. Alternatively, the fire detector can generate an alarm signal that is transferred to a separate alarm, or an alarm signal can be used in any suitable device to trigger an alarm response or indication.

The $CO_2$ detector is preferably an NDIR gas detector. Suitable NDIR detectors could incorporate the teachings of NDIR detectors disclosed in U.S. Pat. No. 5,026,992 to Jacob Y. Wong entitled "Spectral Ratioing Technique for NDIR Gas Analysis" or U.S. Pat. No. 5,341,214 to Jacob Y. Wong entitled "NDIR Gas Analysis Using Spectral Ratioing Technique." $CO_2$ detectors used to measure $CO_2$ concentration levels in parts per million, from which the $CO_2$ rate of change is derived, should be stable and capable of accurate detection over long periods of time. To ensure accuracy and reliability, the drift of this type of $CO_2$ detector should preferably be limited to less than approximately 50 parts per million per five years.

A simpler type of NDIR $CO_2$ detector is disclosed in U.S. Pat. No. 5,163,332 to Jacob Y. Wong entitled "Improved Gas Sample Chamber." This patent describes an NDIR $CO_2$ detector, the output of which is directly indicative of and proportional to the $CO_2$ rate of change. This type of so-called "single beam" NDIR gas detector is simpler, and hence easier, to implement and is consequently among the lowest cost NDIR gas sensors.

Smoke detector 300 can be an ionization type detector, but a photoelectric type of smoke detector is preferred.

Figure 5:
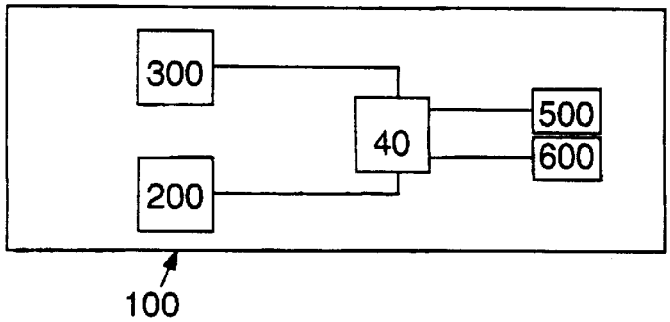
FIG. 5 is a block diagram of an alternative embodiment of the present invention.

The above discussion of this invention is directed primarily to the preferred embodiment and practices thereof. Further modifications are also possible in alternative embodiments without departing from the inventive concept. Thus, for example, the fire detector can be constructed to be programmable for different functions or to meet different requirements. In such a fire detector, any or all of the following can be programmable: the threshold level and the first preselected time, the reduced threshold level and the second preselected time, and the first and second predetermined rates of change. In another modification of the preferred embodiment, the fire detector logic can be altered to provide a first reduced threshold used to generate an alarm signal for detecting a smoldering fire and a second reduced threshold used as a test of the accuracy of the fire indication attributable to the $CO_2$ detector. In another modification of the preferred embodiment, a different alarm or alarm signal can be generated for different types of fires. Such a detector is depicted in FIG. 5, in which fire detector 100 contains a $CO_2$ detector 200, a smoke detector 300, a signal processor 40, a flaming fire alarm 500, and a smoldering or nonflaming fire alarm 600. Of course, the same result could be obtained by using fire alarm 500 to produce different alarms depending upon the type of fire.

Figure 6:
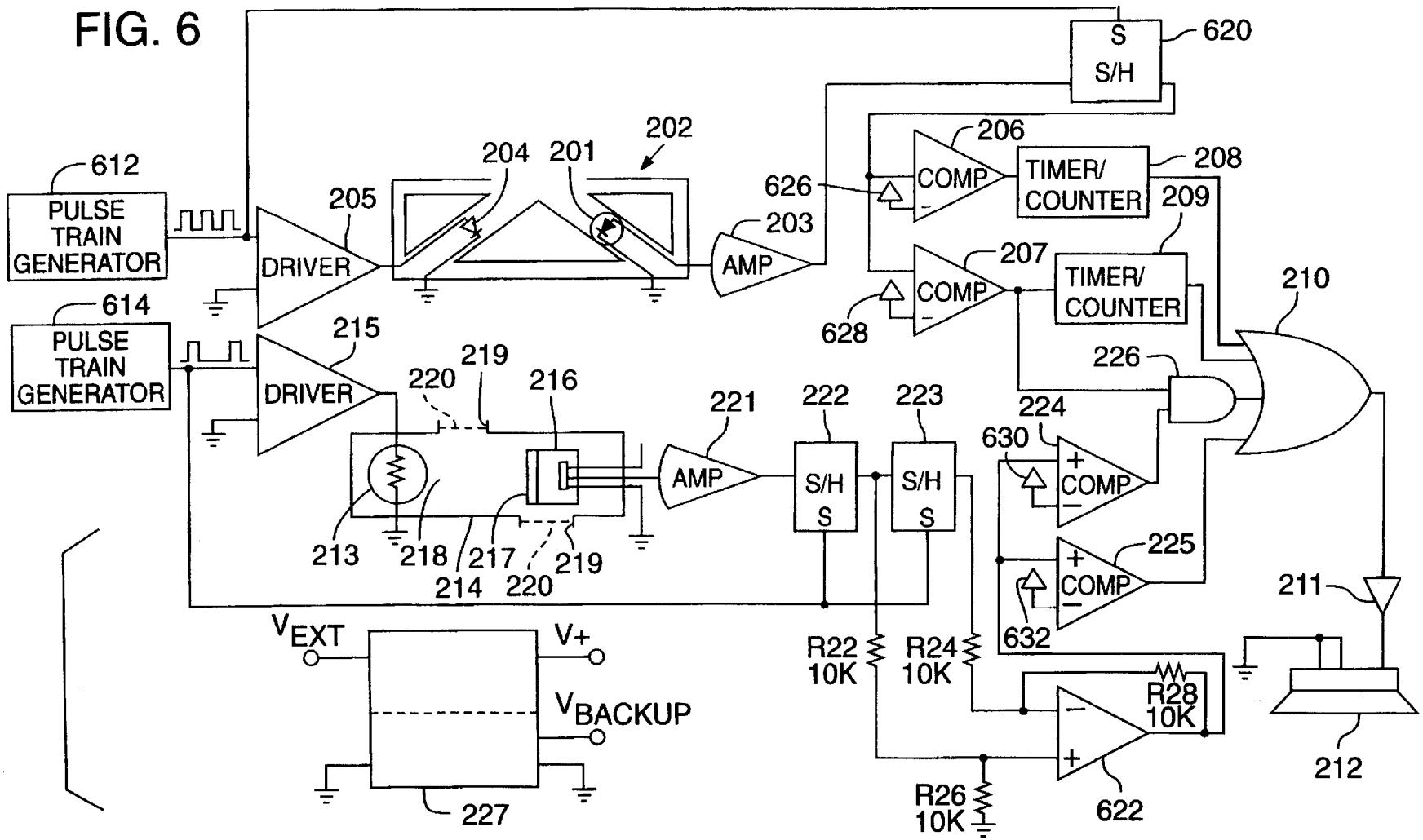
FIG. 6 is a schematic layout of a preferred embodiment of the present invention for a practical and improved fire detector showing a combination of a photoelectric smoke detector and an NDIR $CO_2$ gas detector and their respective signal processing circuit elements and functional relationships.

The logic elements of fire detection system 100 are preferably implemented by the schematic layout shown in FIG. 6.

In the preferred embodiment shown in FIG. 6, a silicon photodiode 201 of a photoelectric smoke detector 202 drives a transimpedance amplifier 203, which has a gain of $-14\times 10^6$. An LED 204 of photoelectric smoke detector 202 is pulsed on and off by a driver 205, which in turn is driven by a pulse train generator 612, which emits a pulse stream having a frequency of typically 0.1 Hertz and a pulse width of about 300 microseconds, thereby causing LED 204 to emit a corresponding light signal. LED 204 is termed to be "pulsed on" when it is emitting light and "pulsed off" when it is not.

Photoelectric detector 202 is preferably a light reflection smoke detector, in which photodiode 201 is not located in the straight line path of light travel from LED 204. Consequently, light from LED 204 reaches photodiode 201 only if smoke reflects the light in the direction of photodiode 201. Under normal operating conditions, i.e., in the absence of a fire, the output of photodiode 201 is near a constant zero amperes because very little light is scattered into it from LED 204. During a fire in which smoke is present in the space between LED 204 and photodiode 201, a pulse stream output signal whose magnitude depends upon the smoke density appears at the output of transimpedance amplifier 203.

The schematic layout of FIG. 6 includes comparators 206, 207, 224, and 225; timer counters 208 and 209; an AND gate 226; and an OR gate 210, each of which has a discrete logic output signal. This type of signal will assume one of two distinct voltage levels depending on the input signal applied to the component. The higher of the two voltage levels is generally termed a "high" output. Conversely, the lower of the two voltage levels is termed a "low" output.

A sample and hold circuit 620 is commanded by the output of pulse train generator 612 to sample the output of transimpedance amplifier 203 every pulse train cycle. The output of sample and hold circuit 620 is fed into a high threshold comparator 206 and a low threshold comparator 207. A reference voltage 626 applied to the inverting input of high threshold comparator 206 is set to a value within a range corresponding to a signal strength of scattered light at photodiode 201 that indicates between 3 percent and 7 percent light obscuration per 0.3048 meter (1 foot) of the light emitted by LED 204. Thus, when the smoke concentration at detector 202 exceeds this level, the output of high threshold comparator 206 will be high. Similarly, a reference voltage 628 applied to the inverting input of low threshold comparator 207 is set to a value within a range corresponding to a signal strength of scattered light at photodiode 201 that indicates between 1 percent and 3 percent light obscuration per 0.3048 meter (1 foot) of the light emitted by LED 204. Thus, when the smoke concentration at detector 202 exceeds this level, the output of low threshold comparator 207 will be high.

The outputs of comparators 206 and 207 are connected to the respective timer counters 208 and 209. For the relatively rapid detection of relatively high smoke density nonflaming fires, timer counter 208 is set to send its output high if the output of high threshold comparator 206 stays high for longer than a time period in the range of two to five minutes. For the relatively slow detection of relatively low smoke density nonflaming fires, timer counter 209 is set to send its output high if the output of low threshold comparator 207 stays high for longer than a time period in the range of 5 to 60 minutes. Timer counters 208 and 209 will be activated only when the output logic states of the respective comparators 206 and 207 are high. The outputs of timer counters 208 and 209 constitute two of the four inputs to OR gate 210. The output of OR gate 210 goes high to indicate detection of a fire. This signal is boosted by an amplifier 211 and is used to sound an auditory alarm 212.

An infrared source 213 of an NDIR $CO_2$ gas detector 214 is pulsed by an electrical current driver 215, which is driven by a pulse train generator 614 at the rate of about 0.1 Hertz to minimize electrical current consumption. The pulsed infrared light radiates through a thin film, narrow bandpass optical filter 217 and onto an infrared detector 216. Optical filter 217 has a center wavelength of about 4.26 microns and a full width at half maximum (FWHM) bandwidth of approximately 0.2 micron. $CO_2$ gas has a very strong infrared absorption band spectrally located at 4.26 microns. The quantity of 4.26-micron light reaching infrared detector 216 depends upon the concentration of $CO_2$ gas present between infrared source 213 and infrared detector 216.

Infrared detector 216 is a single-channel, micromachined silicon thermopile with an optional built-in temperature sensor in intimate thermal contact with the reference junction. Infrared detector 216 could alternatively be a pyroelectric sensor. In an additional alternative, the general function of infrared detector 216 could be performed by other types of detectors, including metal oxide semiconductor sensors such as a "Taguchi" sensor and photochemical (e.g., colorometric) sensors. The supporting circuitry would be fairly different but within the design capabilities of skilled persons. NDIR $CO_2$ detector 214 has a sample chamber 218 with small openings 219 on opposite sides that enable ambient air to diffuse naturally through the sample chamber area between infrared source 213 and infrared detector 216. Small openings 219 are covered with a fiberglass-supported silicon membrane 220 to transmit $CO_2$ and other gasses but prevent dust and moisture-laden particulate matter from entering the sample chamber 218. This type of membrane and its use are described more thoroughly in U.S. Pat. No. 5,053,754 entitled "Simple Fire Detector" and assigned to one of the assignees of the present application.

The output of the infrared detector 216, which is an electrical pulse stream, is first amplified by an amplifier 221, with a gain of 25,000. A second sample-and-hold circuit 222 is commanded by pulse train generator 614 every pulse cycle to sample the resultant pulse stream. Likewise, for every pulse cycle, the output of circuit 222 is sampled by a third sample-and-hold circuit 223.

An operational amplifier 622, configured as a differential amplifier, subtracts the output of second sample-and-hold circuit 223, which represents the next to the last sample, from the output of third sample-and-hold circuit 222, which represents the latest sample. Amplifier 622 is set to unity gain by the values of R22, R24, R26, and R28. The resultant quantity appearing at the output of amplifier 622 is applied to an input of each of a pair of comparators 224 and 225 having different threshold reference voltages.

Comparator 224 is a low rate of rise comparator having a reference voltage 630 that corresponds to a rate of change of $CO_2$ concentration of approximately 150 parts per million per minute. When this rate of change for $CO_2$ is exceeded, the output of comparator 224, which is connected to the second input of AND gate 226, will go high. Because the output of low threshold comparator 207 is connected to the other input of AND gate 226, the output of AND gate 226 goes high when there is a smoke concentration sufficient to cause light obscuration of 1 percent per 0.3048 meter (1 foot) and when $CO_2$ concentration is rising by at least 150 parts per million per minute.

Comparator 225 is the high rate of rise comparator having a reference voltage 632 that corresponds to a rate of change of $CO_2$ concentration of approximately 1,000 parts per million per minute. When this rate of change for $CO_2$ is exceeded, the output of comparator 225, which forms the fourth input to OR gate 210, will go high.

A power supply module 227 takes an external supply voltage $V_{EXT}$ and generates a voltage V+ for powering all the circuitry mentioned earlier.

The use of a thermopile in an NDIR sensor that is part of a fire detection system represents a considerable departure from the conventional wisdom in the gas-sensing field. This is so because a thermopile produces a smaller signal with a lower signal-to-noise ratio than, for example, a pyroelectric sensor. The fact that the present invention combines a smoke detector with the NDIR $CO_2$ sensor helps to make this application practical by reducing the requirement for accuracy of the NDIR $CO_2$ sensor. Moreover, the use of a thermopile reduces the overall cost of the fire detection system.

Figure 7A:
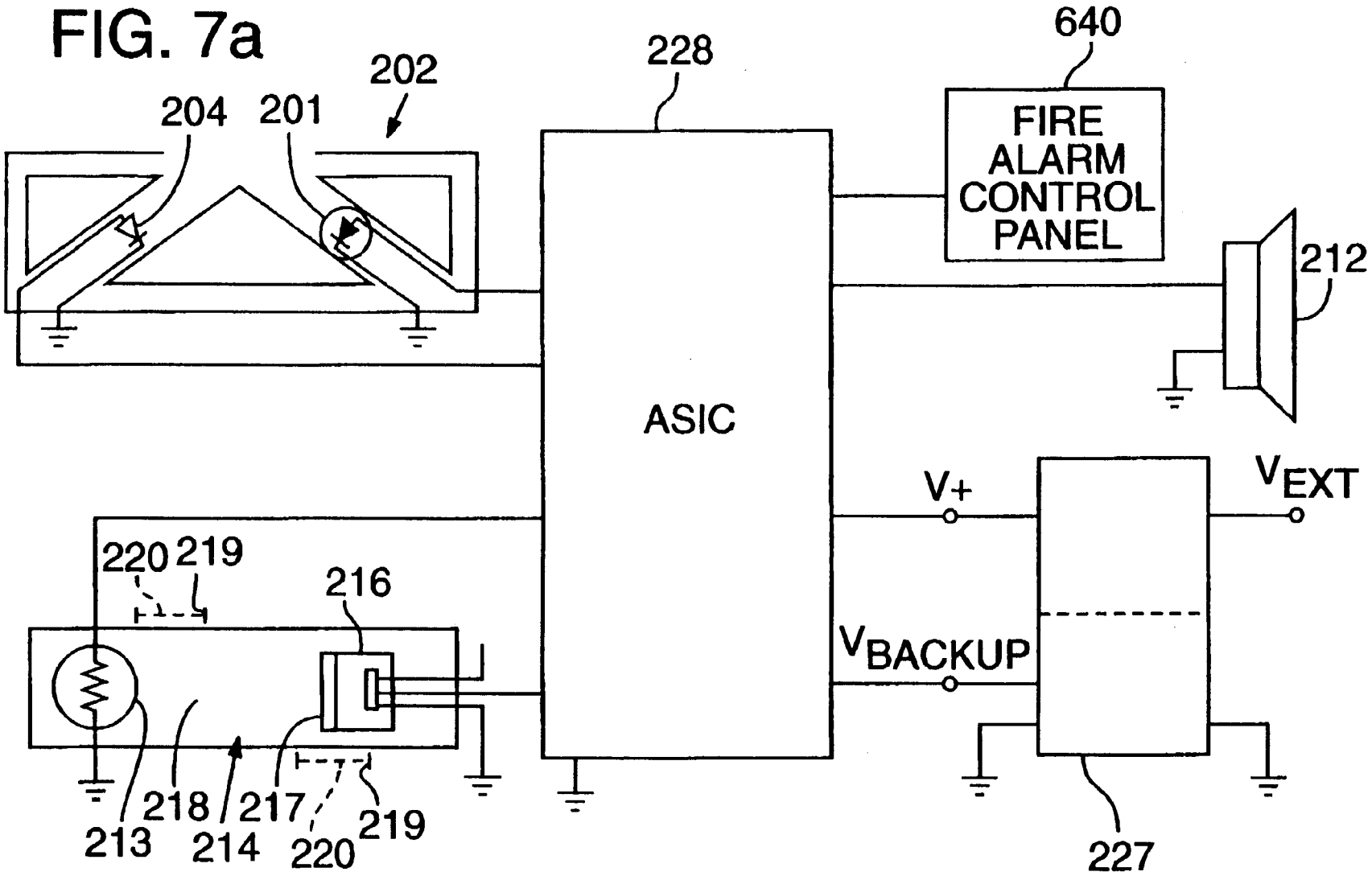
FIG. 7*a* is a schematic layout of a first alternative preferred embodiment of the present invention for a practical and improved fire detector.

In a first alternative preferred embodiment shown in FIG. 7*a*, all the circuit elements described and shown in FIG. 7*a*, with the exception of smoke detector 202, $CO_2$ detector 214, power supply module 227, and auditory alarm 212, are integrated using standard techniques into a single ASIC chip 228. Additionally ASIC 228 may include circuitry for digitizing and formatting the signals representing $CO_2$ level, rate of change of $CO_2$, smoke concentration level, and the presence of an alarm signal. Such circuitry would typically include an analog-to-digital ("A/D") converter and a microprocessor section for formatting the signal into a serial format.

The digitized signals are transmitted typically over a serial bus to a fire alarm control panel 640. Serial communications are a natural choice because the volume of data is typically low enough to be accommodated by this method and reducing power consumption is a primary consideration.

Figure 7B:
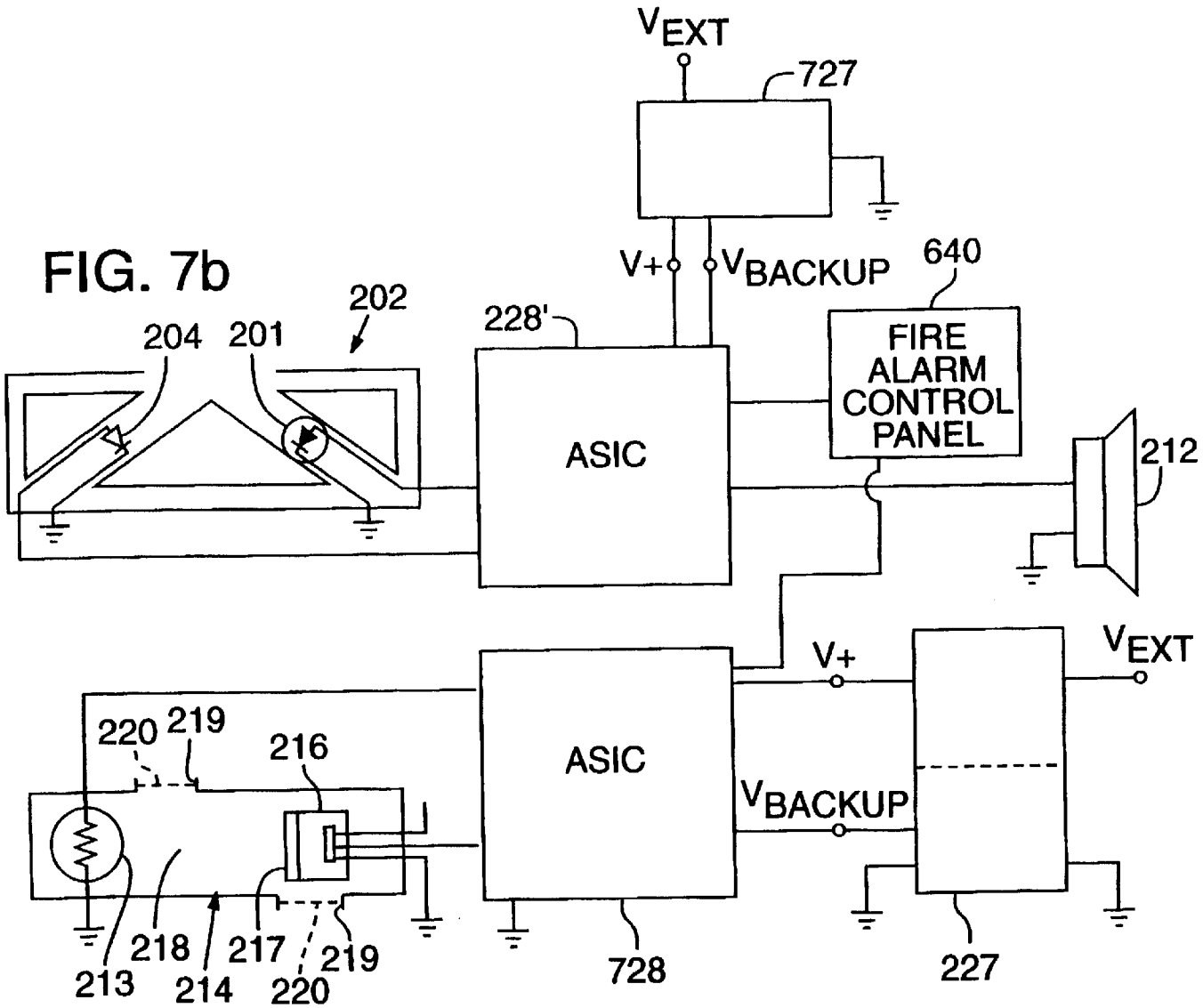
FIG. 7*b* is a schematic layout of a variant of the first alternative preferred embodiment.

Fire alarm control panel 640 preferably performs the data analysis to determine the presence of a fire. In this instance, the fire detection system is considered to encompass fire alarm control panel 640. In a variant of this alternative preferred embodiment, shown in FIG. 7*b*, a first ASIC 228' receives, digitizes, and formats the signal received from smoke detector 202. ASIC 228' sends the resultant data to fire alarm control panel 640. A second ASIC 728 receives, digitizes, and formats the signal received from infrared detector 216. ASIC 728 sends the resultant data to fire alarm control panel 640. A second power supply module 727 powers first ASIC 228'. In this embodiment, ASIC 228' and smoke detector 202 may be physically separate and a distance away from ASIC 728 and $CO_2$ detector 214.

Figure 8:
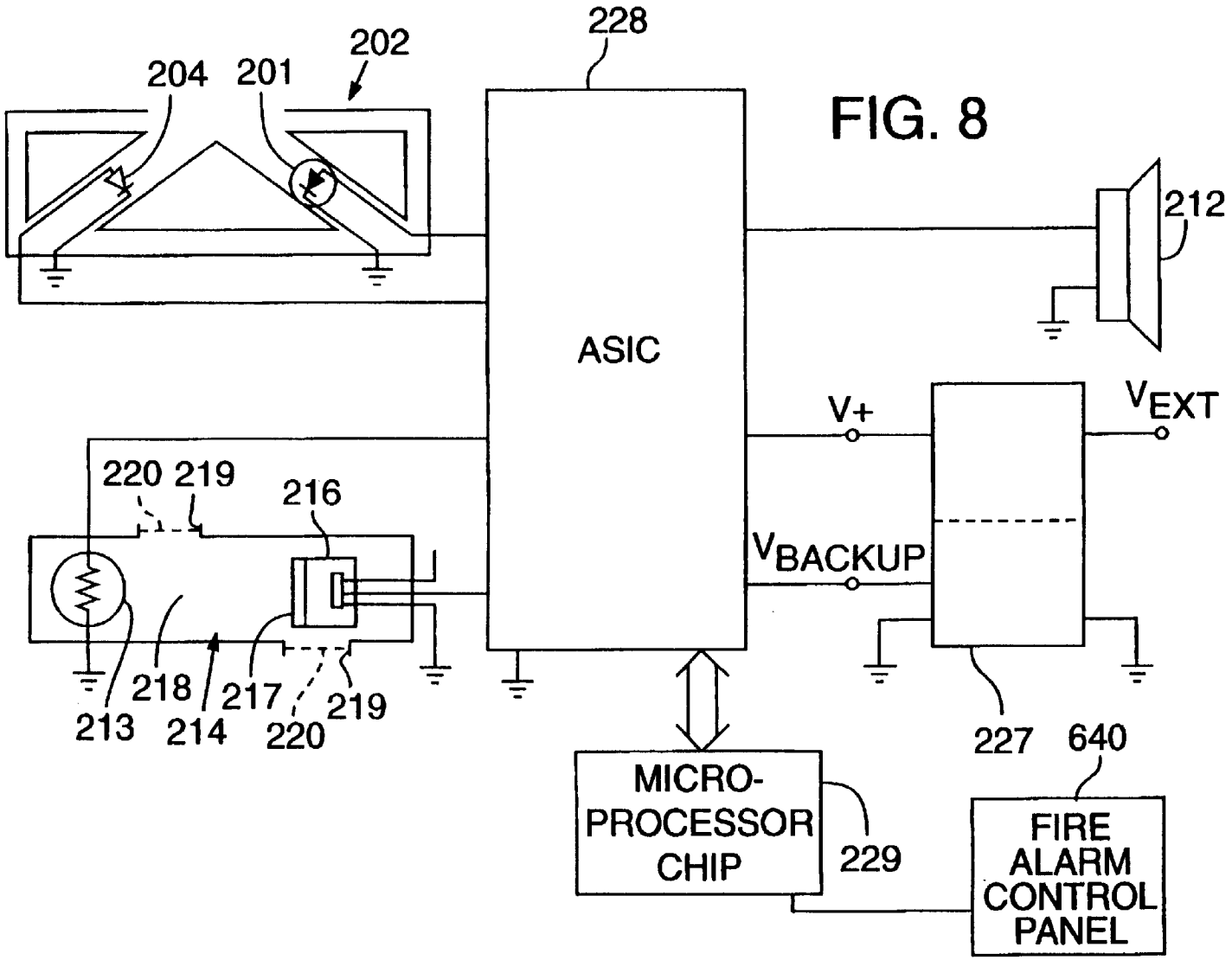
FIG. 8 is a schematic layout of a second alternative preferred embodiment of the present invention for a practical and improved fire detector.

In a second alternative preferred embodiment shown in FIG. 8, a microprocessor 229 communicates with ASIC 228 via a data bus. Commercially available microprocessors typically do not produce outputs capable of driving LED 204 and infrared source 213. Therefore ASIC 228 includes driver circuitry for performing these functions. ASIC 228 also includes an A/D converter and amplifiers for converting the sensor outputs into a form that is in the voltage range of the A/D converter. Microprocessor 229 receives the digitized data from the A/D converter and is programmed to compute the smoke concentration, the $CO_2$ concentration, and the rate of change of $CO_2$ concentration and to implement the detection logic shown in FIG. 2. ASIC 228 receives digital results of this process from microprocessor 229 and changes an alarm declaration into a form that can drive alarm 212.

Figure 9:
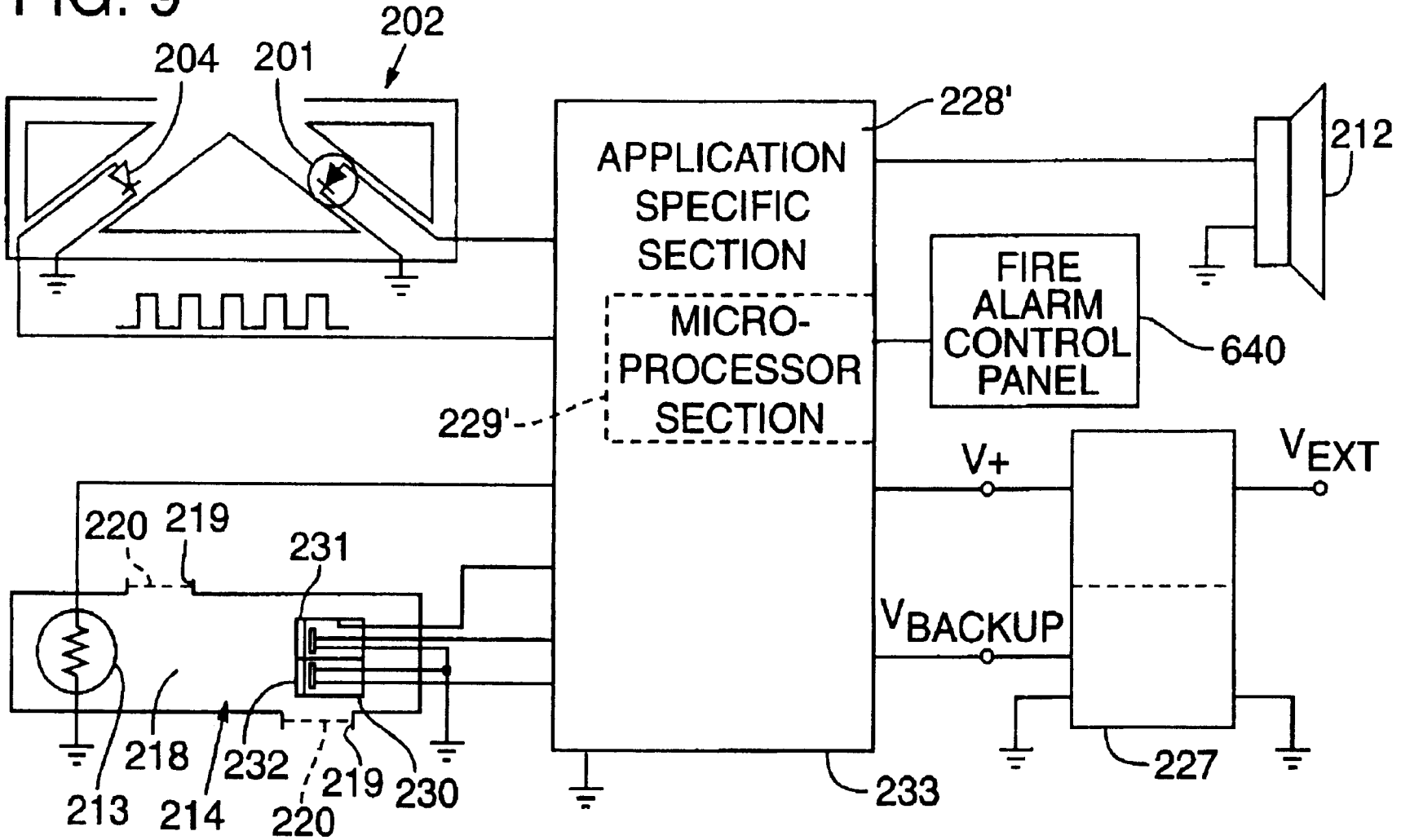
FIG. 9 is a schematic layout of a third alternative preferred embodiment of the present invention for a practical and improved fire detector.

A third alternative preferred embodiment, shown in FIG. 9, improves on the accuracy of NDIR $CO_2$ gas detector 214 relative to the first alternative preferred embodiment. Although smoke is filtered out of sample chamber 218 in both embodiments, there is still some potential for inaccuracy of detector 214 because of the effects of temperature variations and aging. To correct for these phenomena, infrared detector 216 (FIG. 6), which has only one channel, is replaced by a dual-channel silicon micromachined thermopile detector 230. A first optical filter 231, which covers a first channel portion of the surface of detector 230, is a thin film, narrow bandpass interference optical filter having a center wavelength at 4.26 microns and a FWHM bandwidth of 0.2 micron, thereby causing the first channel of detector 230 to respond to changes in the concentration of $CO_2$. A second optical filter 232, which covers a second channel portion of the surface of detector 230, has a center wavelength at 3.91 microns and a FWHM bandwidth of 0.2 micron. The second channel of detector 230 establishes a neutral reference for gas detector 214 because there is no appreciable light absorption by common atmospheric gases in the pass band of optical filter 232. The light attenuation attributable to the presence of $CO_2$, which translates directly to the concentration of $CO_2$, is determined by forming the ratio of light received by the first channel of detector 230 over the light received by the second channel of detector 230 and applying simple algebra. This operation would typically be performed in microprocessor section 229'.

The third alternative preferred embodiment includes a signal processing (SP) integrated circuit 233 that comprises a microprocessor section 229' and an application specific section 228'. Microprocessor section 229' receives the digitized data from an A/D converter application specific section 228' and is programmed to compute the smoke concentration, the $CO_2$ concentration, and the rate of change of $CO_2$ concentration and to implement the detection logic shown in FIG. 6. The $CO_2$ concentration may then be computed by measuring the ratio of the digitized signals from the two channels of detector 230. Further processing may then be performed on the digitized results. Application specific section 228' receives digital information from microprocessor section 229' and changes it into a form that can drive alarm device 212.

Figure 10:
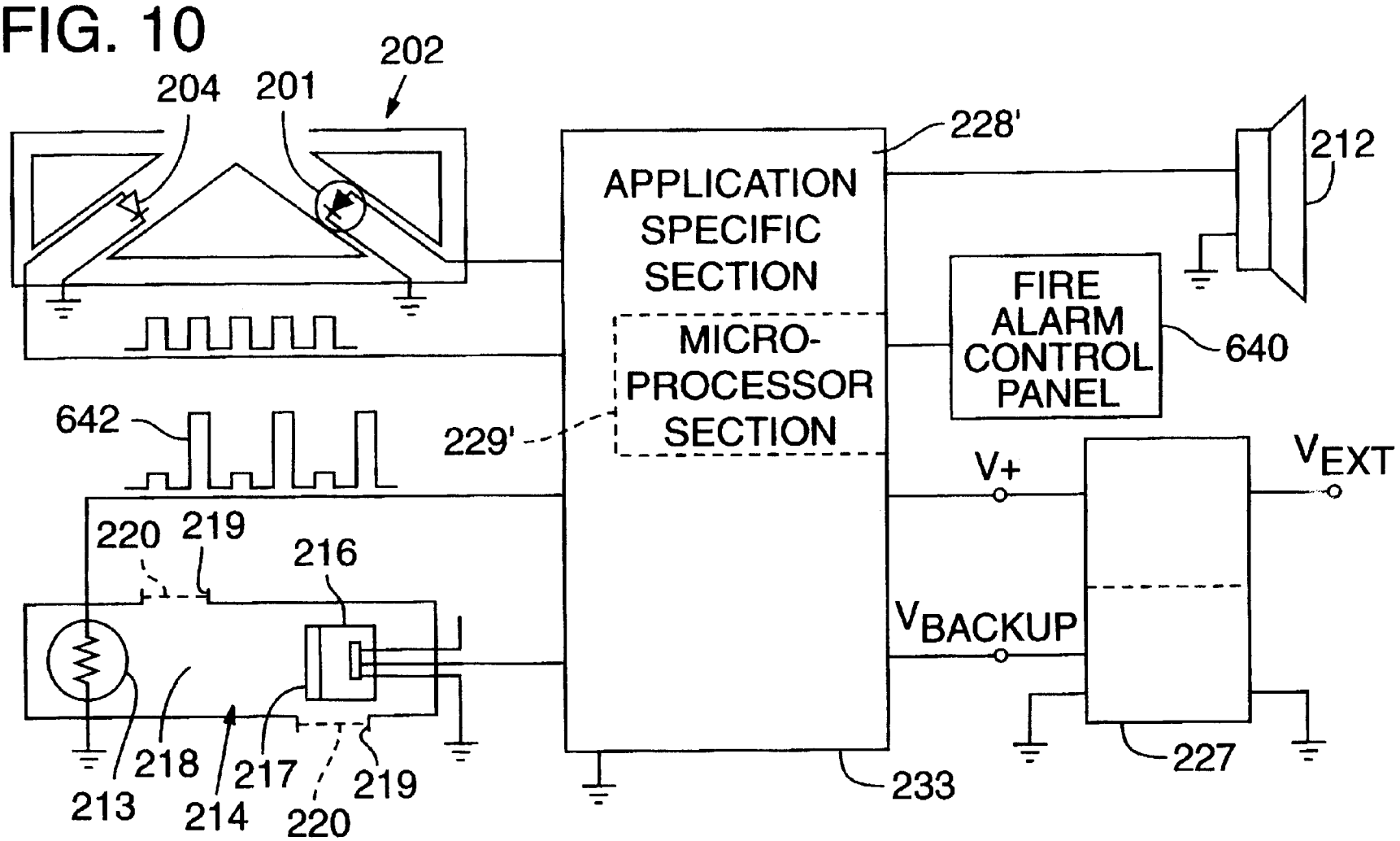
FIG. 10 is a schematic layout of a fourth alternative preferred embodiment of the present invention for a practical and improved fire detector.

In a fourth alternative preferred embodiment shown schematically in FIG. 10, $CO_2$ gas detector 214 is implemented with a gas analysis technique known as "differential sourcing" as disclosed in U.S. Pat. No. 5,026,992, which is assigned to one of the assignees of the present application. This implementation permits a scheme to correct for amplitude variations in 4.26-micron wavelength light received by infrared light detector 216 caused by factors other than $CO_2$ concentration, such as temperature variations, but without requiring a dual pass band infrared detector as in the second alternative preferred embodiment.

In this embodiment, the signal processor (SP) chip 233 comprising both microprocessor section 229' and the application specific section 228' used in the third alternative preferred embodiment (FIG. 9) is retained. The ASIC generates a waveform 642, which comprises a pulse stream of two alternating power levels, to drive the infrared source 213. This permits the use of a single-channel infrared light detector 216 covered by dual pass band optical filter 217 having a first pass band centered at 4.26 microns ($CO_2$) and a second pass band centered at 3.91 microns (neutral).

Both pass bands have FWHM bandwidths of 0.2 micron. The quantity of 4.26-micron light reaching infrared light detector 216 depends, in part, upon the concentration of $CO_2$ gas present between source 213 and detector 216.

The scheme to correct for light detection variations unrelated to $CO_2$ concentration depends on the fact that infrared source 213 emits a different proportion of 4.26-micron light, relative to 3.96-micron light when infrared source 213 is pulsed on at a higher power level compared to when it is pulsed on at a lower power level. The light attenuation of $CO_2$ is determined by forming the ratio of light received by infrared light detector 216 when infrared source 213 is pulsed on at the higher power level over the light received by infrared light detector 216 when infrared source 213 is pulsed off or pulsed on at the lower power level. Simple algebra carried out in microprocessor section 229' yields the light attenuation due to $CO_2$, which translates directly to $CO_2$ concentration.

Figure 11:
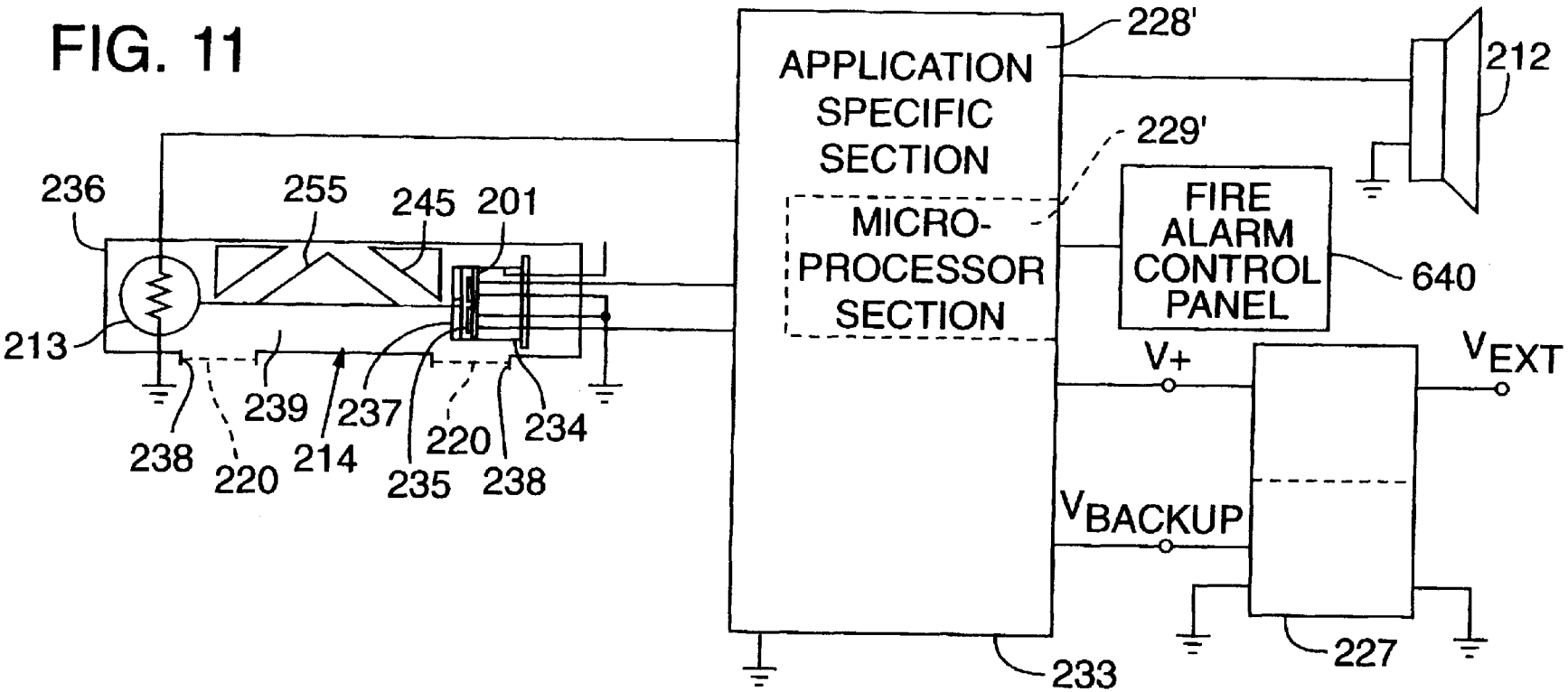
FIG. 11 is a schematic layout of a fifth alternative preferred embodiment of the present invention for a practical and improved fire detector.

In a fifth alternative preferred embodiment of the present invention as shown schematically in FIG. 11, photoelectric smoke detector 202 and NDIR $CO_2$ detector 214 are combined into a single device or detector assembly contained within a single housing 236. A dual-channel detector 234 housed within housing 236 includes a first channel comprising a thermopile detector 235 with a $CO_2$ optical filter 237 (having a pass band centered at 4.26 micron wavelength and a 0.2 micron FWHM bandwidth) and a second channel comprising silicon photodiode 1 fabricated in the vicinity of and on the same substrate as detector 235 but optically isolated from it. Alternatively, the elements enclosed within housing 236 include a single-channel thermopile detector 235 with a dual pass band optical filter that has a first pass band centered at 4.26 microns ($CO_2$) and a second pass band centered at 3.91 microns (neutral). In this alternative, infrared source 213 emits a time varying signal, as in the fourth alternative embodiment illustrated in FIG. 10, so that a reference may be maintained as described in the description of FIG. 10. Light source 213 is typically an incandescent bulb but may alternatively be a tunable laser diode. In an additional alternative, the $CO_2$ detecting mechanism inside housing 236 comprises a double channel thermopile as illustrated in FIG. 9.

Infrared source 213 is a broad band source that emits both 4.26-micron wavelength light for $CO_2$ absorption and detection and 0.88-micron wavelength light for the detection of smoke particles that are smaller than a micron. Inside housing 236, there is a physical light-tight barrier 255 separating the two detector channels. On the $CO_2$ detector side, two or more small openings 238 are made on one side of the container wall opposite barrier 255 that allow ambient air to freely diffuse into and out of a sample chamber 239 of the $CO_2$ detector. Furthermore, these small openings are covered with a special fiberglass-reinforced silicon membrane 220 for screening out any dust, smoke or moisture from sample chamber 239. $CO_2$ and other gases can diffuse freely across this membrane 220 without hindrance.

A photoelectric smoke detector side 245 within housing 236 operates in the same manner as smoke detector 202 of FIG. 6. Photodiode 201 of smoke detector 202 is configured to respond to a 0.88-micron wavelength emitted by light source 213 to provide a signal representative of smoke concentration. Application specific section 228' amplifies the electrical signal produced by photodiode 201. Microprocessor section 229' of signal processor chip 233 processes the resultant data in the same manner as in the preferred embodiment shown in FIG. 6 and described in the accompanying text.

As those skilled in the art will readily recognize, there are a number of ways to manufacture or configure a single-channel infrared detector 216, a dual-channel infrared detector 230 and a dual-channel detector 234, the last of which is composed of a thermopile detector channel 235 and a photodiode detector 201. With respect to detectors 216 and 230, however, the detector and corresponding bandpass optical filter(s) are preferably combined in a single platform such as a TO-5 device package to form an infrared detector assembly. The physical construction of a thermopile/bandpass optical filter combination is described below as part of the description of a passive infrared analysis detector.

An exemplary detector assembly 403 is now described in connection with FIGS. 12 and 13. Although, as illustrated in FIG. 13, the detector assembly 403 includes three thermopile detectors 404, 405, and 406, the physical configuration of each thermopile detector and its supporting elements is generalizable to the infrared detector assemblies of the embodiments shown in FIGS. 6–11. Thermopile detectors 404, 405, and 406 have been formed on a substrate 450 mounted within a detector housing 431. Detector housing 431 is preferably a TO-5 device package, comprising a housing base 430 and a lid 442. Lid 442 includes a collar 407 into which a gas-permeable top cover 420 is set and bonded.

Thermopile detectors 404, 405, and 406 are supported on substrate 450 that is made out of a semiconductor material such as silicon, germanium, gallium arsenide, or the like. Interference band pass filters $F_1$, $F_2$, and $F_3$ are bonded with a thermally conductive material, such as thermally conductive epoxy, to the top of raised rims 482 surrounding apertures 452. An advantage of securing the filters to raised rims 482 with a thermally conductive material is that it improves the thermal shunting between the filters and substrate 450, which is the same temperature as the reference, or cold, junctions of thermopile detectors 404, 405, and 406. As a result, the background noise from the interference filters is minimized.

In the present embodiment, thermopile detectors 404, 405, and 406 are preferably thin film or silicon micromachined thermopiles. Thermopiles 404, 405, and 406 each span an aperture 452 formed in substrate 450. Apertures 452 function as windows through which the radiation that is passed by band pass filters $F_1$, $F_2$, and $F_3$ is detected. As is well known in the art, thin film or micromachined thermopile detectors 404, 405, and 406 are manufactured on the bottom side of substrate 450 and may employ any of a number of suitable patterns. FIG. 12 is an enlarged view of the bottom side of substrate 450 and illustrates one suitable pattern that could be employed for thin film or micromachined thermopile detectors 404, 405, and 406.

As is typical in the art, the hot junctions 460 of each of thermopile detectors 404, 405, and 406 are preferably supported on a thin electrically insulating diaphragm 454 that spans each of apertures 452 formed in substrate 450 and the cold junctions 462 are positioned over the thick substrate 450. Alternatively, diaphragms 454 may be absent and the thermopile detectors 404, 405, and 406 can be self-supporting.

To improve the sensitivity of thermopile detectors 404, 405, and 406 to incident radiation, the top of the electrically insulating diaphragm 454 can be coated with a thin film of bismuth oxide or carbon black during packaging so the aperture areas absorb incident radiation more efficiently. If thermopile detectors 404, 405, and 406 are self-supporting, the side of hot junctions 460 upon which radiation is incident can be directly coated with bismuth oxide or carbon black.

By positioning the cold, or reference, junctions 462 over the thick substrate 450, the reference junctions of each of the detectors are inherently tied to the same thermal mass. Substrate 450 acts, therefore, as a heat sink to sustain the temperature of the cold junctions 462 of each of the detectors at a common temperature. In addition, substrate 450 provides mechanical support for the device.

The present embodiment has been described as a single substrate 450 with three infrared thermopile detectors 404, 405, and 406 formed thereon. As one skilled in the art would recognize, two or three separate substrates each having one infrared thermopile detector manufactured thereon could be used in place of substrate 450 described in the present embodiment.

Electrically insulating diaphragm 454 may be made from a number of suitable materials well known in the art, including a thin plastic film such as Mylar® or an inorganic dielectric layer such as silicon oxide, silicon nitride, or a multilayer structure composed of both. Preferably, diaphragm 454 is a thin inorganic dielectric layer because such layers can be easily fabricated using well-known semiconductor manufacturing processes and, as a result, more sensitive thermopile detectors can be fabricated on substrate 450. Moreover, the manufacturability of the entire device is improved significantly. Also, by employing only semiconductor processes to manufacture thermopile detectors 404, 405, and 406, substrate 450 will have on-chip circuit capabilities characteristic of devices that are based on the full range of silicon integrated circuit technology; thus, the signal processing electronics for thermopile detectors 404, 405, and 406 can, if desired, be included on substrate 450.

A number of techniques for manufacturing thermopile detectors 404, 405, and 406 on the bottom side of substrate 450 are well known in the thermopile and infrared detector arts. One method suitable for producing thermopile detectors 404, 405, and 406 using semiconductor processing techniques is disclosed in U.S. Pat. No. 5,100,479, issued Mar. 31, 1992.

Output leads 456 are electrically connected using solder or other well-known materials to output pads 464 of each of the thermopile detectors 404, 405, and 406. Because the reference junctions of thermopile detectors 404, 405, and 406 are thermally shunted to one another, it is possible for the reference junctions for each of the thermopile detectors 404, 405, and 406 to share a common output pad. As a result, only four, rather than six, output leads would be required to communicate the output of the detectors. The output leads 456 typically connect the thermopile detectors 404, 405, and 406 to signal processing electronics. As mentioned above, however, the signal processing electronics can be included directly on substrate 450, in which case output leads 456 would be connected to the input and output pads of the signal processing electronics, rather than to the output pads from the infrared thermopile detectors 404, 405, and 406.

A temperature sensing element 453 is preferably constructed on substrate 450 near cold junctions 462 of thermopile detectors 404, 405, and 406. The temperature-sensing element monitors the temperature of substrate 450 in the area of the cold junctions and thus the temperature it measures is representative of the temperature of the cold junctions 462. The output from temperature-sensing element 453 is communicated to the signal processing electronics so the signal processing electronics can compensate for the influence of the ambient temperature of the cold junctions of the thermopile detectors. Temperature sensing element 453 is preferably a thermistor, but other temperature sensing elements, such as diodes, transistors, and the like can also be used.

Figure 12:
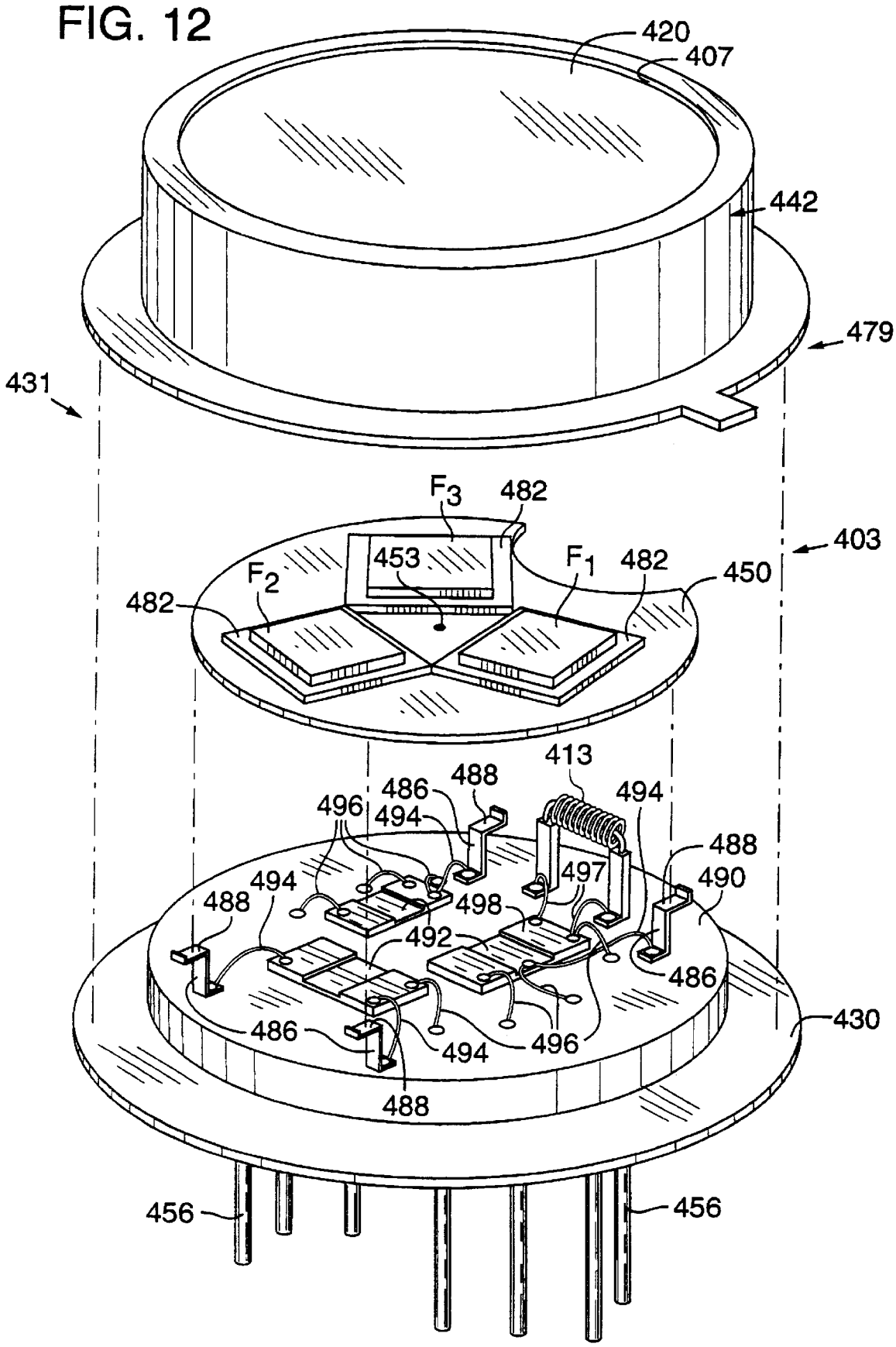
FIG. 12 is an exploded isometric view of an infrared detector assembly exemplary for use in the present invention.
Figure 13:
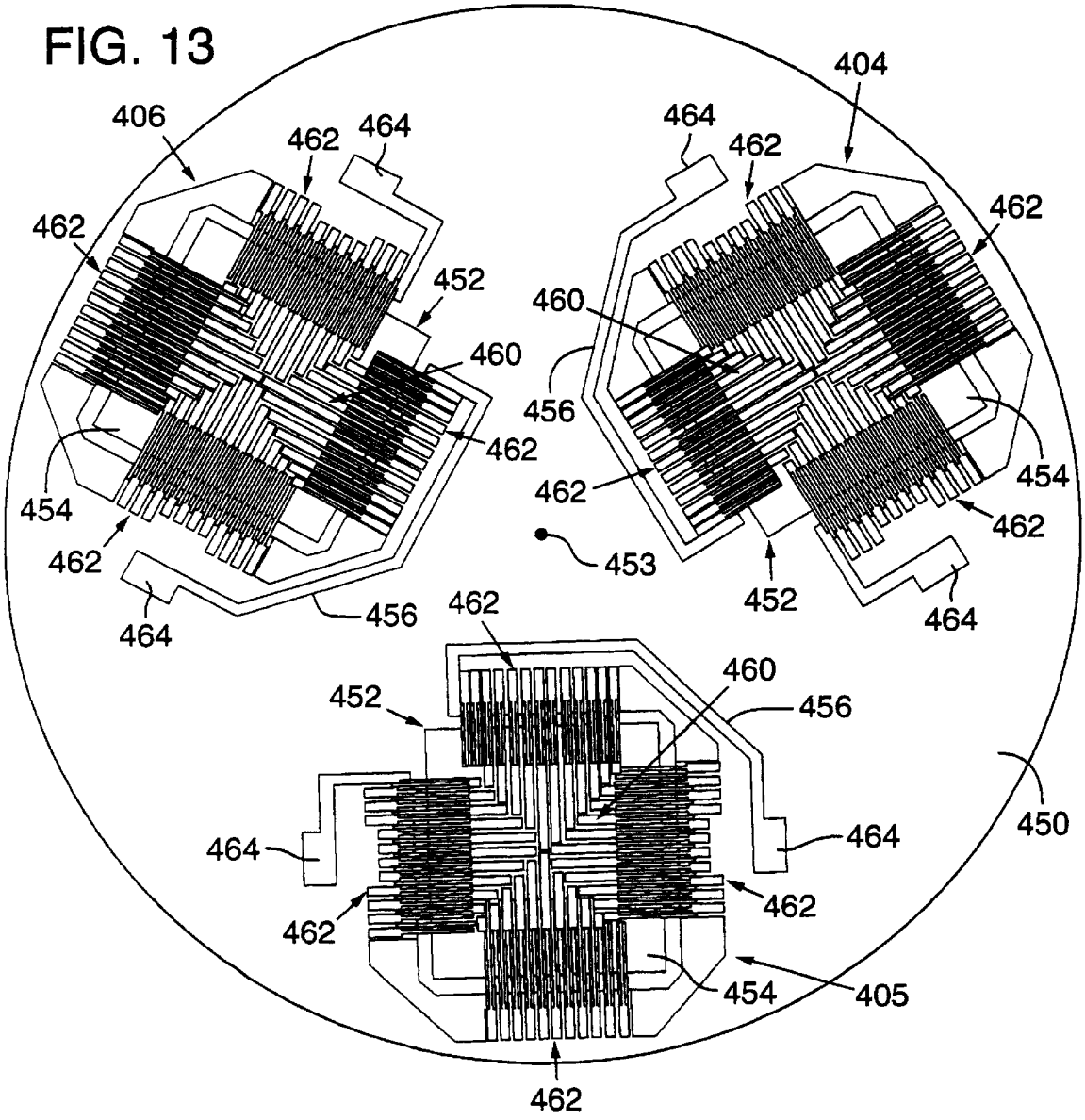
FIG. 13 is an enlarged bottom view of substrate 450 of FIG. 12 showing thermopiles manufactured thereon.

In FIGS. 12 and 13, interference band pass filters $F_1$, $F_2$, and $F_3$ are mounted on the top of substrate 450 so they each cover one of apertures 452 in substrate 450. Because the interference filters cover apertures 452, light from incandescent lamp 413 first passes through filter $F_1$, $F_2$, or $F_3$ before reaching thermopile detector 404, 405, or 406, respectively. Thus, by employing three separate apertures in substrate 450, light passing through one of the filters is isolated from the light passing through one of the other filters. This prevents cross talk between the detector channels. Therefore, the light that reaches thermopile detectors 404, 405, and 406 from incandescent lamp 413 is light falling within the spectral band intended to be measured by the particular detector. This construction is generalizable to the two-channel case shown in FIG. 11. Incandescent lamp 413 works as infrared source 13 works, as described in the text that refers to FIGS. 6–11.

Substrate mounting fixtures 486 are connected using solder or other well-known materials to the output pads (not shown) of each of the thermopile detectors 404, 405, and 406 at bonding regions 488. Because the reference junctions of the thermopile detectors 404, 405, and 406 share a common output pad in the present embodiment, only four substrate mounting fixtures 486 are required to communicate the outputs of the detectors. Substrate mounting fixtures are insulated from the housing base 430 of detector housing 431 because they are mounted on an electrically insulative substrate 490, which is preferably made from a material consisting of aluminum oxide and beryllium oxide. The output signal from thermopile detectors 404, 405, and 406 is communicated through substrate mounting fixtures 486, via wire bonds 494, to signal processing electronics 492. Signal processing electronics 492 can comprise a plurality of microchips or a single microchip diebonded to insulative substrate 490. Output leads 456 are connected via wire bonds 496 to the input and output of the signal processing electronics 492.

Signal processing electronics 492 includes a source driver 498 that, through wire bonds 497, drives active infrared source 413 at a known frequency. The manner in which source driver 498 drives active infrared source 413 for conventional NDIR applications is well known in the art and need not be explained further herein.

It will be obvious to those having skill in the art that many changes may be made to the details of the above-described embodiments of this invention without departing from the underlying principles thereof. The scope of the present invention should, therefore, be determined only by the following claims.

What is claimed is:

1. In a fire detector having a smoke detector for producing a smoke detector output signal and electrical circuitry for receiving the smoke detector output signal and for generating an alarm signal in response to the satisfaction of a smoke detector output signal fire detection criteria, a method for dynamically adjusting the smoke detector output signal fire detection criteria, comprising:

providing a carbon dioxide ($CO_2$) detector for forming a sequence of measurements of $CO_2$ concentration;

providing a communicative connection between the $CO_2$ detector and the electrical circuitry;

sending the measurements of $CO_2$ concentration from the $CO_2$ detector to the electrical circuitry by way of the communicative connection;

determining an estimate of the a priori probability of the existence of a fire from the $CO_2$ measurements; and altering a smoke detector output signal fire detection criterion in response to the estimate of the a priori probability of the existence of a fire.

2. The method of claim 1 in which the estimate of the a priori probability of the existence of a fire is responsive to the rate of change of $CO_2$ concentration.

3. The method of claim 1 in which the estimate of the a priori probability of the existence of a fire is representative of the rate of change of $CO_2$ concentration.

4. The method of claim 3 in which the smoke detector output signal fire detection criteria includes a first criterion specified by the smoke concentration exceeding a first predetermined level for a first predetermined time duration and in which, whenever the estimate of the a priori probability of the existence of a fire reflects a rate of change of $CO_2$ in excess of a predetermined rate, the first criterion is replaced by a second criterion specified by the smoke concentration exceeding the first predetermined level for a second predetermined period of time and the second predetermined period of time is shorter than the first predetermined time duration.

5. The method of claim 4 in which the second predetermined period of time is sufficiently brief that a single smoke concentration measurement above the first predetermined level will satisfy the second criterion.

6. The method of claim 4 in which the first predetermined rate is between approximately 150 and 250 parts per million per minute.

7. The method of claim 4 in which, whenever the rate of change of $CO_2$ is greater than or equal to a second predetermined rate that is greater than the first predetermined rate, the second criterion is replaced by a third criterion that is satisfied whenever the smoke concentration exceeds a second predetermined level that is less than the first predetermined level.

8. The method of claim 7 in which the second predetermined rate equals 1,000 parts per million per minute.

9. The method of claim 4 in which the first predetermined time duration is more than 5 minutes but fewer than 60 minutes.

10. The method of claim 1, further comprising generating a fire category designation in response to the smoke detector output signal and the measurements of $CO_2$ concentration.

11. The method of claim 10 in which the fire category designation indicates a smoldering fire or a nonsmoldering fire.

12. The method of claim 1 in which the $CO_2$ detector includes a first light source for emitting infrared light having a first frequency in the absorption band of $CO_2$, a first light detector for substantially exclusively receiving the first frequency infrared light emitted by the first light source, and an electrical circuit electrically connected to the first infrared light detector for computing the instantaneous concentration of $CO_2$ and emitting the $CO_2$ detector output signal.

13. The method of claim 12 in which the first light source additionally emits infrared light having a second frequency that is not in the absorption band of $CO_2$, the $CO_2$ detector comprises a second light detector for substantially exclusively detecting the second frequency infrared light emitted by the first light source, and the electrical circuit is electrically connected to the second light detector and computes the ratio of the amount of light detected by the first light detector over the amount of light detected by the second light detector to determine the instantaneous concentration of $CO_2$.

14. The method of claim 12 in which the first light source additionally emits infrared light having a second frequency that is not in the absorption band of $CO_2$; in which the first light source is controlled to alternate between a first phase, during which the first light source emits light having a first proportion of first frequency light to second frequency light, and a second phase, during which the first light source emits light having a second proportion of first frequency light to second frequency light; and in which the electrical circuit computes the ratio of first phase light reception to second phase light reception to determine the concentration of $CO_2$.

15. The method of claim 12 in which the $CO_2$ detector further comprises a sampling chamber for isolating the air through which the light from the first light source passes, the sampling chamber includes perforated walls, and the perforations are covered with a gas-permeable barrier to block particles from entering the sampling chamber.

16. The method of claim 12 in which the first light source emits light having a first wavelength band that extends over the range of about 700 nm to 4,300 nm, the smoke detector includes a second light detector for exclusively detecting light emitted from the light source over a second light detector for exclusively detecting light emitted from the light source over a second wavelength band having a center wavelength of between about 600 and 1,500 nm, and the smoke detector computes a smoke concentration measurement based on the intensity of light received.

17. The method of claim 11 in which the fire detector includes an integrated circuit and the electrical circuitry comprises a portion of the integrated circuit.

18. The method of claim 12 in which the fire detector comprises an integrated circuit that includes a first electrical pulse stream-producing electrical driver circuit electrically connected to the first light source for driving the first light source.

19. The method of claim 18 in which the integrated circuit further comprises a microprocessor section.

20. The method of claim 12 in which the smoke detector is a photoelectric smoke detector comprising a second light source and a second light detector that detects the light from the second light source, the amount of light received by the second light detector being related to the amount of smoke in the locality of the smoke detector, and in which the fire detector further comprises an integrated circuit that includes:

a first electrical pulse stream-producing electrical driver circuit electrically connected to the first light source for driving the first light source; and a second electrical pulse stream producing electrical driver circuit electrically connected to the second light source for driving the second light source.

21. The method of claim 1 in which the smoke detector is a photoelectric smoke detector comprising a first light source and a first light detector that detects light propagating from the light source, the amount of light received by the light detector being related to the amount of smoke in the locality of the smoke detector.

22. The method of claim 12 in which the first infrared light detector comprises a thermopile.

23. The method of claim 22 in which the thermopile is micromachined.

24. The method of claim 22 in which the fire detector comprises an integrated circuit and the integrated circuit includes the electrical circuitry, and in which the thermopile is integrated into the integrated circuit to form a combination sensor/integrated circuit.

25. The method of claim 13 in which the smoke detector is a photoelectric smoke detector comprising an LED and a photodiode that receives light from the LED to form the first signal, and in which the photodiode is integrated into the combination sensor/integrated circuit.

26. A fire detector comprising:

a smoke detector for producing a smoke detector output signal;

electrical circuitry for receiving the smoke detector output signal and for generating an alarm signal in response to the satisfaction of a smoke detector output signal fire detection criterion;

a carbon dioxide ($CO_2$) detector, communicatively connected to the electrical circuitry, for forming a sequence of measurements of $CO_2$ concentration, the electrical circuitry determining an estimate of the a priori probability of the existence of a fire from the measurements of $CO_2$ concentration and altering the smoke detector output signal fire detection criterion in response to the estimate of the a priori probability of the existence of a fire.

* * * * *